US011414853B2

(12) United States Patent
Boatwright

(10) Patent No.: US 11,414,853 B2
(45) Date of Patent: Aug. 16, 2022

(54) APPARATUS FOR A BUILDING FRAME DESIGNED TO CREATE A BUILDING

(71) Applicant: Garry Lynn Boatwright, Amarillo, TX (US)

(72) Inventor: Garry Lynn Boatwright, Amarillo, TX (US)

( * ) Notice: Subject to any disclaimer, the term of this patent is extended or adjusted under 35 U.S.C. 154(b) by 0 days.

(21) Appl. No.: 17/067,295

(22) Filed: Oct. 9, 2020

(65) Prior Publication Data

US 2021/0115656 A1 Apr. 22, 2021

Related U.S. Application Data

(60) Provisional application No. 62/916,594, filed on Oct. 17, 2019.

(51) Int. Cl.
*E04B 1/19* (2006.01)
*E04B 1/24* (2006.01)

(52) U.S. Cl.
CPC ..... *E04B 1/1912* (2013.01); *E04B 1/2403* (2013.01); *E04B 2001/1933* (2013.01); *E04B 2001/1957* (2013.01); *E04B 2001/1966* (2013.01); *E04B 2001/1972* (2013.01); *E04B 2001/1993* (2013.01); *E04B 2001/249* (2013.01); *E04B 2001/2415* (2013.01); *E04B 2001/2421* (2013.01); *E04B 2001/2466* (2013.01)

(58) Field of Classification Search
CPC .. E04B 1/19; E04B 1/1912; E04B 2001/1915; E04B 1/2403; E04B 2001/2421; E04B 2001/2424; E04B 2001/1966; E04B 2001/1993; E04B 2001/2466; E04B 2001/249
USPC ..... 52/653.1, 653.2
See application file for complete search history.

(56) References Cited

U.S. PATENT DOCUMENTS 2,797,233 A * 6/1957 Lott ..... C07D 295/088 560/51
3,206,903 A * 9/1965 Johnson ..... E04B 1/26 52/92.1
3,845,601 A * 11/1974 Kostecky ..... E04B 1/2403 52/290
3,885,367 A * 5/1975 Thunberg ..... E04B 2/822 52/204.1
2013/0000242 A1* 1/2013 Ferguson ..... E04B 2/767 52/653.1
2016/0032581 A1* 2/2016 Sklar ..... E04B 1/1903 52/220.8

* cited by examiner

*Primary Examiner* — William V Gilbert

(57) ABSTRACT

Disclosed herein is an apparatus for a building frame designed to create a building, in accordance with some embodiments. Accordingly, the apparatus may include a plurality of base plates. Further, the apparatus may include a plurality of top plates. Further, the apparatus may include a plurality of studs. Further, each stud of the plurality of studs may include an elongated stud body having an upper stud end and a lower stud end. Further, the apparatus may include a plurality of rafters. Further, each rafter of the plurality of rafters may include a first slab body. Further, the each rafter may include a first cuboidal body. Further, the apparatus may include a plurality of braces corresponding to a plurality of brace lengths.

20 Claims, 46 Drawing Sheets

APPARATUS FOR A BUILDING FRAME DESIGNED TO CREATE A BUILDING

The current application claims a priority to the U.S. Provisional Patent application Ser. No. 62/767,317 filed on Nov. 14, 2019.

FIELD OF THE INVENTION

Generally, the present disclosure relates to the field of building units and construction elements. More specifically, the present disclosure relates to an apparatus for a building frame designed to create a building.

BACKGROUND OF THE INVENTION

Existing techniques for a building frame designed to create a building are deficient with regard to several aspects. For instance, current technologies do not facilitate the construction of the building in dangerous weather conditions. Furthermore, current technologies do not allow construction of the building without contractors and manpower.

Therefore, there is a need for improved apparatus for a building frame designed to create a building that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is an apparatus for a building frame designed to create a building, in accordance with some embodiments. Accordingly, the apparatus may include a plurality of base plates. Further, each base plate of the plurality of base plates may include an elongated base plate body. Further, the elongated base plate body may include at least one external lower base plate surface configured to be placed in contact with a ground surface and at least one external upper base plate surface opposed to the at least one external lower base plate surface. Further, the each base plate may include a plurality of base couplers disposed along a length of the elongated base plate body and on the at least one external upper base plate surface. Further, each base coupler may be configured to be detachably attached with a lower stud end of a stud. Further, the apparatus may include a plurality of top plates. Further, each top plate of the plurality of top plates may include an elongated top plate body may include at least one external lower top plate surface and at least one external upper top plate surface opposed to the at least one external lower top plate surface. Further, the each top plate may include a plurality of top couplers disposed along a length of the elongated top plate body and on the at least one external lower top plate surface. Further, each top coupler may be configured to be detachably attached with an upper stud end of the stud. Further, the apparatus may include a plurality of studs. Further, each stud of the plurality of studs may include an elongated stud body having an upper stud end and a lower stud end. Further, the upper stud end may be configured to be detachably attached with a top coupler of the plurality of top couplers. Further, the lower stud end may be configured to be detachably attached with a base coupler of the plurality of base couplers. Further, the apparatus may include a plurality of rafters. Further, each rafter of the plurality of rafters may include a first slab body. Further, the first slab body may include a first left slab surface and a first right slab surface opposing the first left slab surface. Further, the first slab body may be characterized by a first slab length, a first slab height, and a first slab width. Further, the each rafter may include a first cuboidal body. Further, the first cuboidal body may include a first left cuboidal surface and a first right cuboidal surface opposing the first left cuboidal surface. Further, the first right cuboidal surface may be attached to the first left slab surface along an upper boundary of the first left slab surface. Further, the first cuboidal body may be characterized by a first cuboidal width, a first cuboidal height, and a first cuboidal length. Further, the first slab height may be greater than the first cuboidal height by a predetermined ratio. Further, the first cuboidal length may be greater than the first slab length by a predetermined extent. Further, an extended portion of the first cuboidal body equally extends out on either sides of the first slab body according to the predetermined extent. Further, the first right cuboidal surface corresponding to the extended portion may not be juxtaposed with the first left slab surface. Further, the apparatus may include a plurality of braces corresponding to a plurality of brace lengths. Further, each brace may include an elongated brace body characterized by a corresponding brace length, a left bracket attached to and extending from a left end of the elongated brace body, and a right bracket attached to and extending from a right end of the elongated brace body. Further, each brace may be configured to fasten any two of a base plate, a top plate, the stud, and a rafter with each other using a brace fastener.

Further disclosed herein is an apparatus for a building frame designed to create a building, in accordance with some embodiments. Accordingly, the apparatus may include a plurality of base plates. Further, each base plate of the plurality of base plates may include an elongated base plate body. Further, the elongated base plate body may include at least one external lower base plate surface configured to be placed in contact with a ground surface and at least one external upper base plate surface opposed to the at least one external lower base plate surface. Further, the apparatus may include a plurality of base couplers configured to be detachably attached along a length of the elongated base plate body and on the at least one external upper base plate surface using a base coupler fastener. Further, each base coupler may be configured to be detachably attached with a lower stud end of a stud. Further, each base coupler may include a base coupler aperture configured to receive the base coupler fastener. Further, the at least one external upper base plate surface may include a base plate aperture configured to receive the base coupler fastener. Further, the apparatus may include a plurality of top plates. Further, each top plate of the plurality of top plates may include an elongated top plate body may include at least one external lower top plate surface and at least one external upper top plate surface opposed to the at least one external lower top plate surface. Further, the apparatus may include a plurality of top couplers configured to be detachably attached along a length of the elongated top plate body and on the at least one external lower top plate surface using a top coupler fastener. Further, each top coupler may be configured to be detachably attached with an upper stud end of the stud. Further, each top coupler may include a top coupler aperture configured to receive the top coupler fastener. Further, the at least one external lower top plate surface may include a top plate aperture configured to receive the top coupler fastener.

Further, the apparatus may include a plurality of studs. Further, each stud of the plurality of studs may include an elongated stud body having an upper stud end and a lower stud end. Further, the upper stud end may be configured to be detachably attached with a top coupler of the plurality of top couplers. Further, the lower stud end may be configured to be detachably attached with a base coupler of the plurality of base couplers. Further, the apparatus may include a plurality of rafters. Further, each rafter of the plurality of rafters may include a first slab body. Further, the first slab body may include a first left slab surface and a first right slab surface opposing the first left slab surface. Further, the first slab body may be characterized by a first slab length, a first slab height, and a first slab width. Further, the each rafter may include a first cuboidal body. Further, the first cuboidal body may include a first left cuboidal surface and a first right cuboidal surface opposing the first left cuboidal surface. Further, the first right cuboidal surface may be attached to the first left slab surface along an upper boundary of the first left slab surface. Further, the first cuboidal body may be characterized by a first cuboidal width, a first cuboidal height, and a first cuboidal length. Further, the first slab height may be greater than the first cuboidal height by a predetermined ratio. Further, the first cuboidal length may be greater than the first slab length by a predetermined extent. Further, an extended portion of the first cuboidal body equally extends out on either side of the first slab body according to the predetermined extent. Further, the first right cuboidal surface corresponding to the extended portion may not be juxtaposed with the first left slab surface. Further, the apparatus may include a plurality of braces corresponding to a plurality of brace lengths. Further, each brace may include an elongated brace body characterized by a corresponding brace length, a left bracket attached to and extending from a left end of the elongated brace body, and a right bracket attached to and extending from a right end of the elongated brace body. Further, each brace may be configured to fasten any two of a base plate, a top plate, the stud, and a rafter with each other using a brace fastener.

Further disclosed herein is an apparatus for a building frame designed to create a building, in some embodiments. Accordingly, the apparatus may include a plurality of base plates. Further, each base plate of the plurality of base plates may include an elongated base plate body. Further, the elongated base plate body may include at least one external lower base plate surface configured to be placed in contact with a ground surface and at least one external upper base plate surface opposed to the at least one external lower base plate surface. Further, the each base plate may include a plurality of base couplers disposed along a length of the elongated base plate body and on the at least one external upper base plate surface. Further, each base coupler may be configured to be detachably attached with a lower stud end of a stud. Further, the plurality of base couplers may include a plurality of base protrusions. Further, each base protrusion may be characterized by a protrusion width and a protrusion height. Further, the lower stud end may include a lower stud receptacle configured to receive a base protrusion of the plurality of base protrusions. Further, the lower stud receptacle may be characterized by a receptacle depth and a receptacle width. Further, receptacle depth may be greater than the protrusion height. Further, the receptacle width may be greater than the protrusion width by a predetermined clearance. Further, the plurality of top couplers may include a plurality of top protrusions. Further, the upper stud end may include an upper stud receptacle configured to receive a top protrusion of the plurality of top protrusions. Further, the elongated stud body may include a hollow cuboidal body characterized by a stud width, a stud height, a stud length, and a stud thickness. Further, the lower stud end may include a cut-away opening on a first side of the hollow cuboidal body. Further, the cut-away opening may be characterized by a cut-away width and a cut-away height. Further, the cut-away width may be greater than the protrusion width by the predetermined clearance. Further, the cut-away height may be greater than the protrusion height by the predetermined clearance. Further, the apparatus may include a plurality of top plates. Further, each top plate of the plurality of top plates may include an elongated top plate body may include at least one external lower top plate surface and at least one external upper top plate surface opposed to the at least one external lower top plate surface. Further, the each top plate may include a plurality of top couplers disposed along a length of the elongated top plate body and on the at least one external lower top plate surface. Further, each top coupler may be configured to be detachably attached with an upper stud end of the stud. Further, the apparatus may include a plurality of studs. Further, each stud of the plurality of studs may include an elongated stud body having an upper stud end and a lower stud end. Further, the upper stud end may be configured to be detachably attached with a top coupler of the plurality of top couplers. Further, the lower stud end may be configured to be detachably attached with a base coupler of the plurality of base couplers. Further, the apparatus may include a plurality of rafters. Further, each rafter of the plurality of rafters may include a first slab body. Further, the first slab body may include a first left slab surface and a first right slab surface opposing the first left slab surface. Further, the first slab body may be characterized by a first slab length, a first slab height, and a first slab width. Further, the each rafter may include a first cuboidal body. Further, the first cuboidal body may include a first left cuboidal surface and a first right cuboidal surface opposing the first left cuboidal surface. Further, the first right cuboidal surface may be attached to the first left slab surface along an upper boundary of the first left slab surface. Further, the first cuboidal body may be characterized by a first cuboidal width, a first cuboidal height, and a first cuboidal length. Further, the first slab height may be greater than the first cuboidal height by a predetermined ratio. Further, the first cuboidal length may be greater than the first slab length by a predetermined extent. Further, an extended portion of the first cuboidal body equally extends out on either side of the first slab body according to the predetermined extent. Further, the first right cuboidal surface corresponding to the extended portion may not be juxtaposed with the first left slab surface. Further, the apparatus may include a plurality of braces corresponding to a plurality of brace lengths. Further, each brace may include an elongated brace body characterized by a corresponding brace length, a left bracket attached to and extending from a left end of the elongated brace body, and a right bracket attached to and extending from a right end of the elongated brace body. Further, each brace may be configured to fasten any two of a base plate, a top plate, the stud, and a rafter with each other using a brace fastener.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
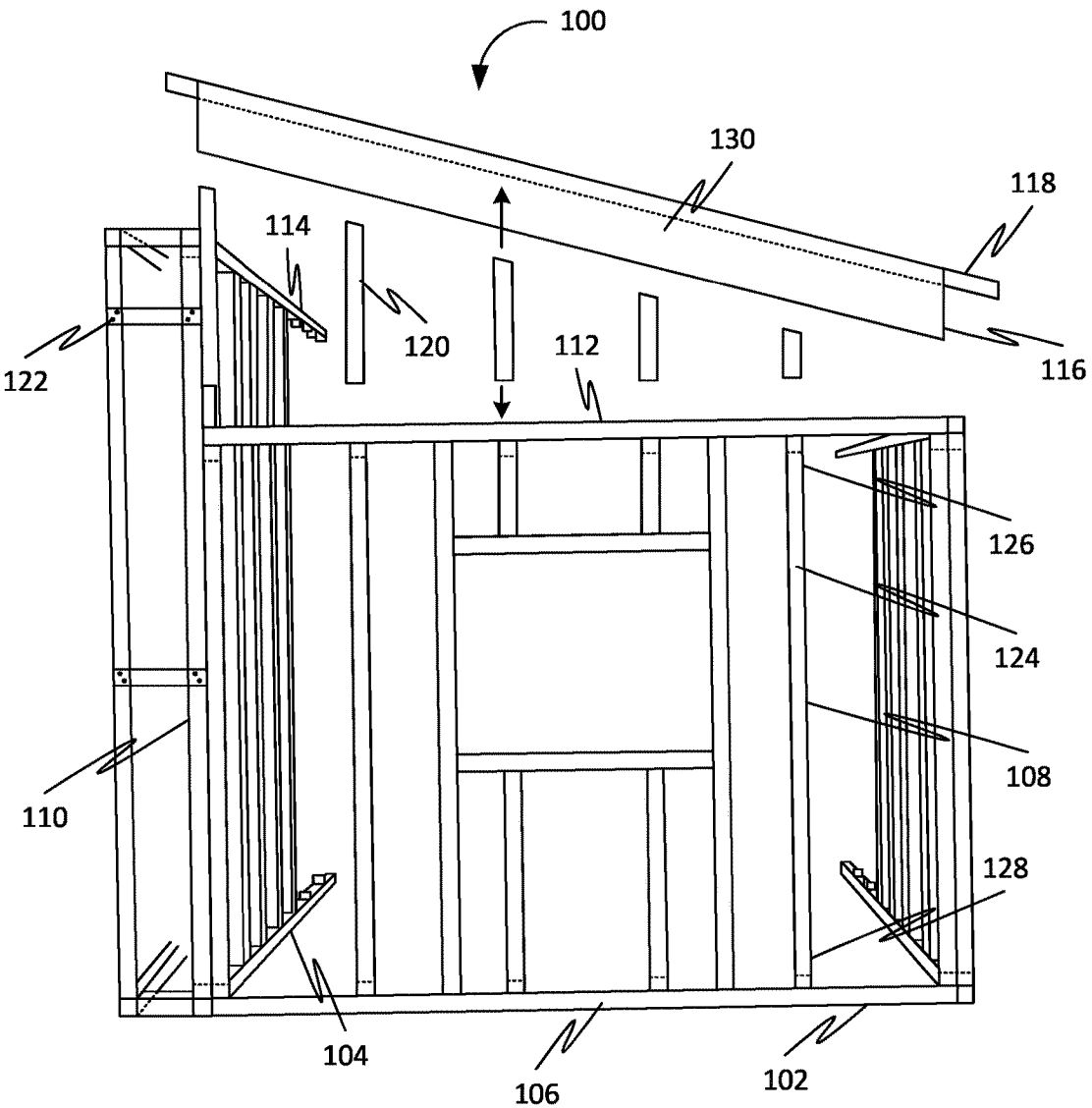
FIG. 1 is a side view of an apparatus for a building frame designed to create a building, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive.

Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of apparatus for a building frame designed to create a building, embodiments of the present disclosure are not limited to use only in this context.

Overview:

The present disclosure describes an apparatus for a building frame designed to create a building. Further, the apparatus may include a building frame designed to create a new method to build super strong homes or buildings that practically any person can afford to build. Further, expensive contractors may not be required. Further, simple components (or components) associated with the building frame may be easily attached. Further, the components are precut ready to connect together. Further, the method is a low-cost affordable method than ever designed. Constructing buildings may be an expensive project needing many workers. Constructing new buildings is also time-consuming. Areas with dangerous weather need more attention to compensate for the elements. Areas with poor funding may also have a hard time finding the quality material to build with. Further, in locations where equipment, labor, contractors, and materials are very hard to find, especially in storm weather-related areas as mountains and coastal areas, the apparatus may be associated with strong wind loads and snow loads. Further, in storm damage communities, the building may be rebuilt quickly without waiting on contractors using the apparatus. Further, the components are made with galvanized square tube steel. Further, the apparatus may be fireproof, termite-proof, and much more. Further, the cost of creating a building using the apparatus is approx. 50% less cost to build than any other type. Further, mortgage loans can be dropped from 30 years down to ten-year loans. Further, the apparatus for the wall may be made with wall thickness and the apparatus for the ceiling may be made with ceiling thickness to hold the highest energy-efficient insulation rating ever made on earth. Further, the apparatus may include maintenance-free exteriors with steel roofing and walls attached. Further, a material associated with the apparatus may be available worldwide.

Figure 2:
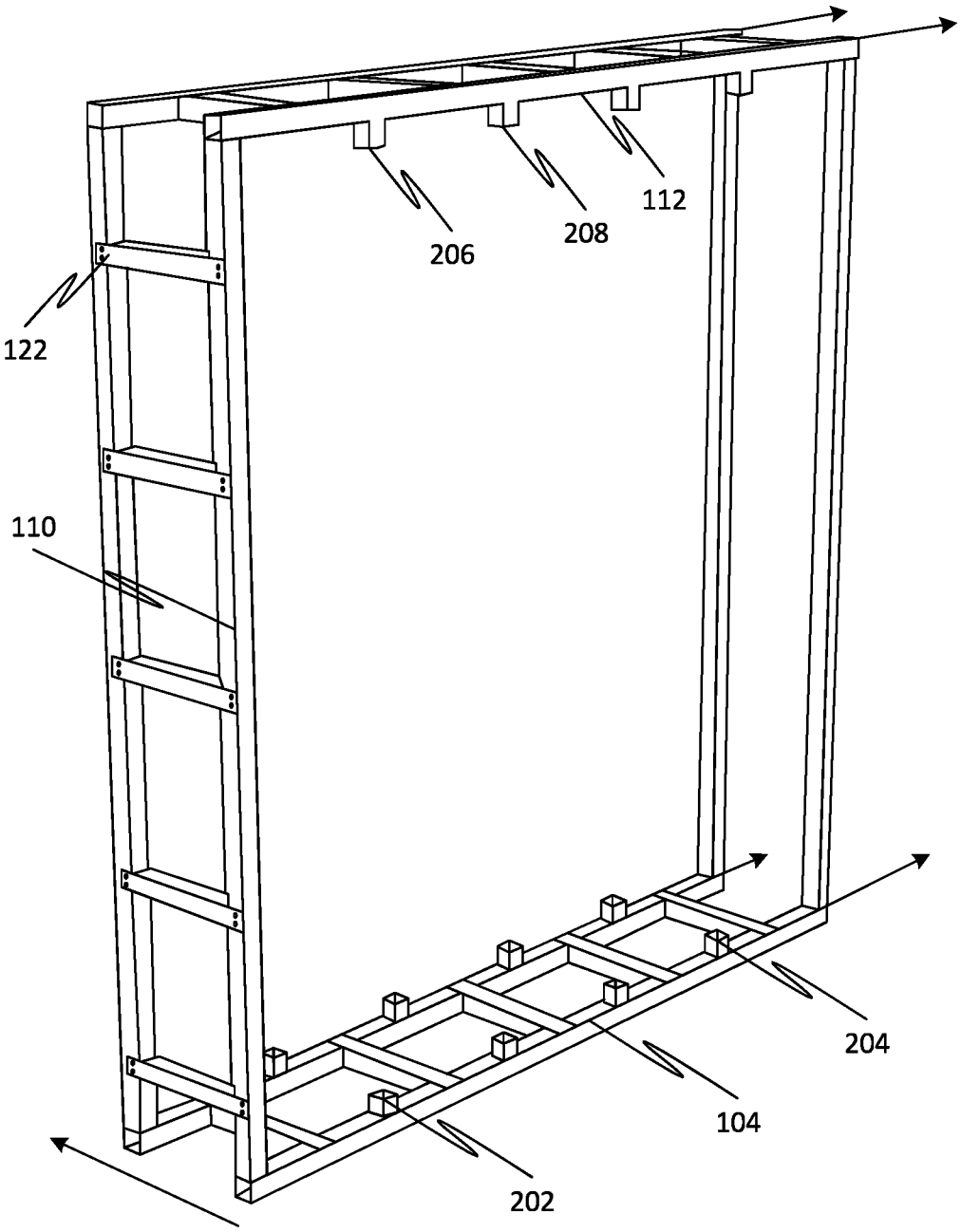
FIG. 2 is a top right side perspective view of a wall of the apparatus, in accordance with some embodiments.

FIG. 1 is a side view of an apparatus 100 for a building frame designed to create a building, in accordance with some embodiments. Accordingly, the apparatus 100 may include a plurality of base plates 102-104. Further, each base plate of the plurality of base plates 102-104 may include an elongated base plate body 106. Further, the elongated base plate body 106 may include at least one external lower base plate surface configured to be placed in contact with a ground surface and at least one external upper base plate surface opposed to the at least one external lower base plate surface. Further, the each base plate may include a plurality of base couplers 202-204 (as shown in FIG. 2) disposed along a length of the elongated base plate body 106 and on the at least one external upper base plate surface. Further, each base coupler of the plurality of base couplers 202-204 may be configured to be detachably attached with a lower stud end 128 of a stud 108. Further, the apparatus 100 may include a plurality of top plates 112-114. Further, each top plate of the plurality of top plates 112-114 may include an elongated top plate body may include at least one external lower top plate surface and at least one external upper top plate surface opposed to the at least one external lower top plate surface. Further, the each top plate may include a plurality of top couplers 206-208 (as shown in FIG. 2) disposed along a length of the elongated top plate body and on the at least one external lower top plate surface. Further, each top coupler may be configured to be detachably attached with an upper stud end 126 of the stud 108. Further, a base plate 102 of the plurality of base plates 102-104 and a second base plate 104 of the plurality of base plates 102-104 may be marked exemplarily.

Further, the apparatus 100 may include a plurality of studs 108-110. Further, each stud of the plurality of studs 108-110 may include an elongated stud body 124 having the upper stud end 126 and the lower stud end 128. Further, the upper stud end 126 may be configured to be detachably attached with a top coupler 206 of the plurality of top couplers 206-208. Further, the lower stud end 128 may be configured to be detachably attached with a base coupler 202 of the plurality of base couplers 202-204. Further, the plurality of studs 108-110 may include the stud 108. Further, the stud 108 of the plurality of studs 108-1101 and a second stud 110 of the plurality of studs 108-110 may be marked exemplarily. Further, the base coupler 202 of the plurality of base couplers 202-204 and a second base coupler 204 of the plurality of base couplers 202-204 may be marked exemplarily. Further, the top coupler 206 of the plurality of top couplers 206-208 and a second top coupler 208 of the plurality of top couplers 206-208 may be marked exemplarily.

Further, the apparatus 100 may include a plurality of rafters 130. Further, each rafter of the plurality of rafters 130 may include a first slab body 116 may include a first left slab surface and a first right slab surface opposing the first left slab surface. Further, the first slab body 116 may be characterized by a first slab length, a first slab height, and a first slab width. Further, the each rafter may include a first cuboidal body 118. Further, the first cuboidal body 118 may include a first left cuboidal surface and a first right cuboidal surface opposing the first left cuboidal surface. Further, the first right cuboidal surface may be attached to the first left slab surface along an upper boundary of the first left slab surface. Further, the first cuboidal body 118 may be characterized by a first cuboidal width, a first cuboidal height, and a first cuboidal length. Further, the first slab height may be greater than the first cuboidal height by a predetermined ratio. Further, the first cuboidal length may be greater than the first slab length by a predetermined extent. Further, an extended portion of the first cuboidal body 118 equally extends out on either side of the first slab body 116 according to the predetermined extent. Further, the first right cuboidal surface corresponding to the extended portion may not be juxtaposed with the first left slab surface. Further, in an embodiment, the first cuboidal body 118 may include the stud 108 of the plurality of studs 108-110. Further, the predetermined ratio may be three. Further, the first slab height may be three times or more the first cuboidal height.

Figure 5:
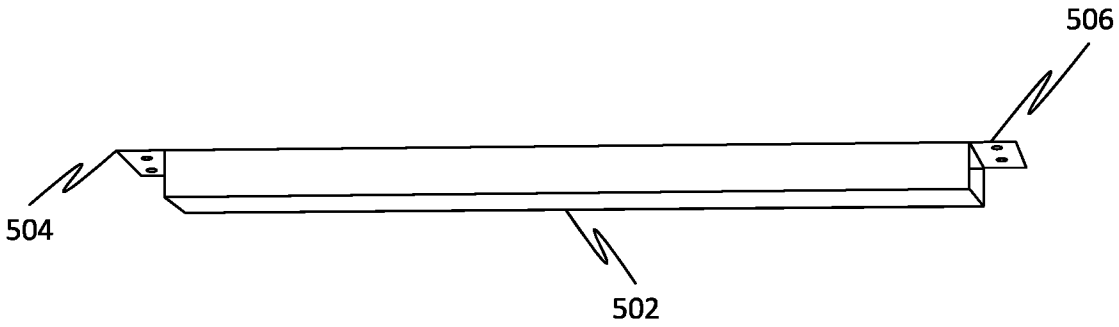
FIG. 5 is a side view of the plurality of braces associated with the apparatus, in accordance with some embodiments.

Further, the apparatus 100 may include a plurality of braces 120-122 corresponding to a plurality of brace lengths. Further, each brace of the plurality of braces 120-122 may include an elongated brace body characterized by a corresponding brace length, a left bracket 504 (as shown in FIG. 5) attached to and extending from a left end of the elongated brace body and a right bracket 506 (as shown in FIG. 5) attached to and extending from a right end of the elongated brace body. Further, each brace may be configured to fasten any two of the base plate 102, a top plate 112, the stud 108, and a rafter 130 with each other using a brace fastener. Further, the top plate 112 of the plurality of top plates 112-114 and a second top plate 114 of the plurality of top plates 112-114 may be marked exemplarily. Further, the plurality of rafters 130 may be marked exemplarily. Further, a brace 120 of the plurality of braces 120-122 and a second brace 122 of the plurality of braces 120-122 may be marked exemplarily.

Figure 3:
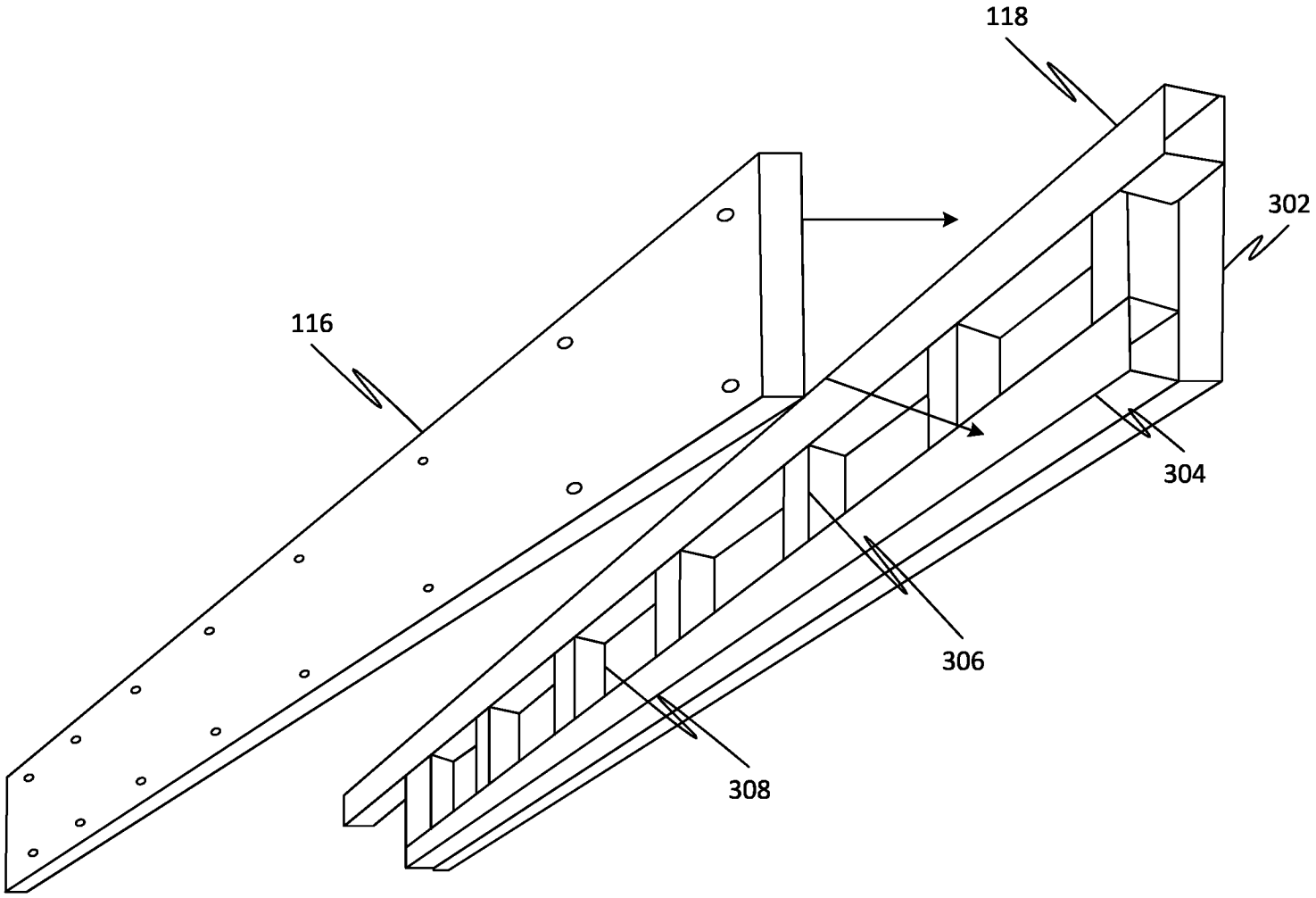
FIG. 3 is a bottom right side perspective view of the rafter of the plurality of rafters, in accordance with some embodiments.

Further, in some embodiments, the each rafter may include a second slab body 302 (as shown In FIG. 3). Further, the second slab body 302 may include a second left slab surface and a second right slab surface opposing the second left slab surface. Further, the second slab body 302 may be characterized by a second slab length, a second slab height, and a second slab width. Further, the each rafter may include a second cuboidal body 304 (as shown in FIG. 3). Further, the second cuboidal body 304 may include a second left cuboidal surface and a second right cuboidal surface opposing the second left cuboidal surface. Further, the second right cuboidal surface may be attached to the first left slab surface along a lower boundary of the first left slab surface. Further, the second left cuboidal surface may be attached to the second right slab surface along a lower boundary of the second right slab surface. Further, the second cuboidal body 304 may be characterized by a second cuboidal width, a second cuboidal height, and a second cuboidal length. Further, the first slab height may be greater than the second cuboidal height by the predetermined ratio. Further, the second cuboidal length may be identical to the first slab length. Further, the second cuboidal body 304 may be attached the first cuboidal body 118 through a plurality of blocks 306-308 (as shown in FIG. 3). Further, a block 306 of the plurality of blocks 306-308 and a second block 308 of the plurality of blocks 306-308 may be marked exemplarily. Further, in an embodiment, the second cuboidal body 304 may include the stud 108 of the plurality of studs 108-110. Further, the predetermined ratio may be 3. Further, the second slab height may be thrice (or more) the second cuboidal height.

Further, the each rafter may include the plurality of blocks 306-308. Further, each block of the plurality of blocks 306-308 may include a left block surface, a right block surface, a bottom block surface, and a top block surface. Further, the right block surface may be attached to the first left slab surface. Further, the left block surface may be attached to the second right slab surface. Further, the top block surface may be attached to a first lower cuboidal surface. Further, the lower block surface may be attached to a second upper cuboidal surface.

In further embodiments, the apparatus 100 may include the plurality of base couplers 202-204. Further, each of the plurality of base couplers 202-204 and the at least one external upper base plate surface may be configured to be attached to each other using at least one of a base fastener and welding. Further, the apparatus 100 may include the plurality of top couplers 206-208. Further, each of the plurality of top couplers 206-208 and the at least one external lower top plate surface may be configured to be attached to each other using at least one of a top fastener and welding.

Further, in some embodiments, the elongated base plate body 106 may include a hollow cuboidal body characterized by a width, a height, a length, and a thickness. Further, the at least one external lower base plate surface may include a lower side surface of the hollow cuboidal body. Further, the at least one external upper base plate surface may include an upper side surface of the hollow cuboidal body.

Further, in some embodiments, the elongated top plate body may include a hollow cuboidal body characterized by a width, a height, a length, and a thickness. Further, the at least one external lower top plate surface may include a lower side surface of the hollow cuboidal body. Further, the at least one external upper top plate surface may include an upper side surface of the hollow cuboidal body.

Further, in some embodiments, each of the upper stud end 126 of the stud 108 and the top coupler 206 may be configured to be detachably attached with each other without any fastener. Further, each of the lower stud end 128 and the base coupler 202 may be configured to be detachably attached with each other without any fastener.

Further, in some embodiments, attaching of the upper stud end 126 of the stud 108 and the top coupler 206 prevents any linear movement of the stud 108 in relation to the top plate 112 may include the top coupler 206. Further, attaching of the lower stud end 128 of the stud 108 and the base coupler 202 prevents any linear movement of the stud 108 in relation to the base plate 102 may include the base coupler 202.

Further, in some embodiments, the plurality of base couplers 202-204 may be disposed equidistantly on the base plate 102. Further, the plurality of top couplers 206-208 may be disposed equidistantly on the top plate 112. Further, a base plate length of the base plate 102 may be identical to a top plate length of the top plate 112. Further, aligning a first base plate end of the base plate 102 with a first top plate end of the top plate 112 and aligning a second base plate end of the base plate 102 with a second top plate end of the top plate 112 results in an alignment of the plurality of top couplers 206-208 with the plurality of base couplers 202-204.

Further, in some embodiments, the plurality of base plates 102-104 may be identical to the plurality of top plates 112-114.

Figure 4:
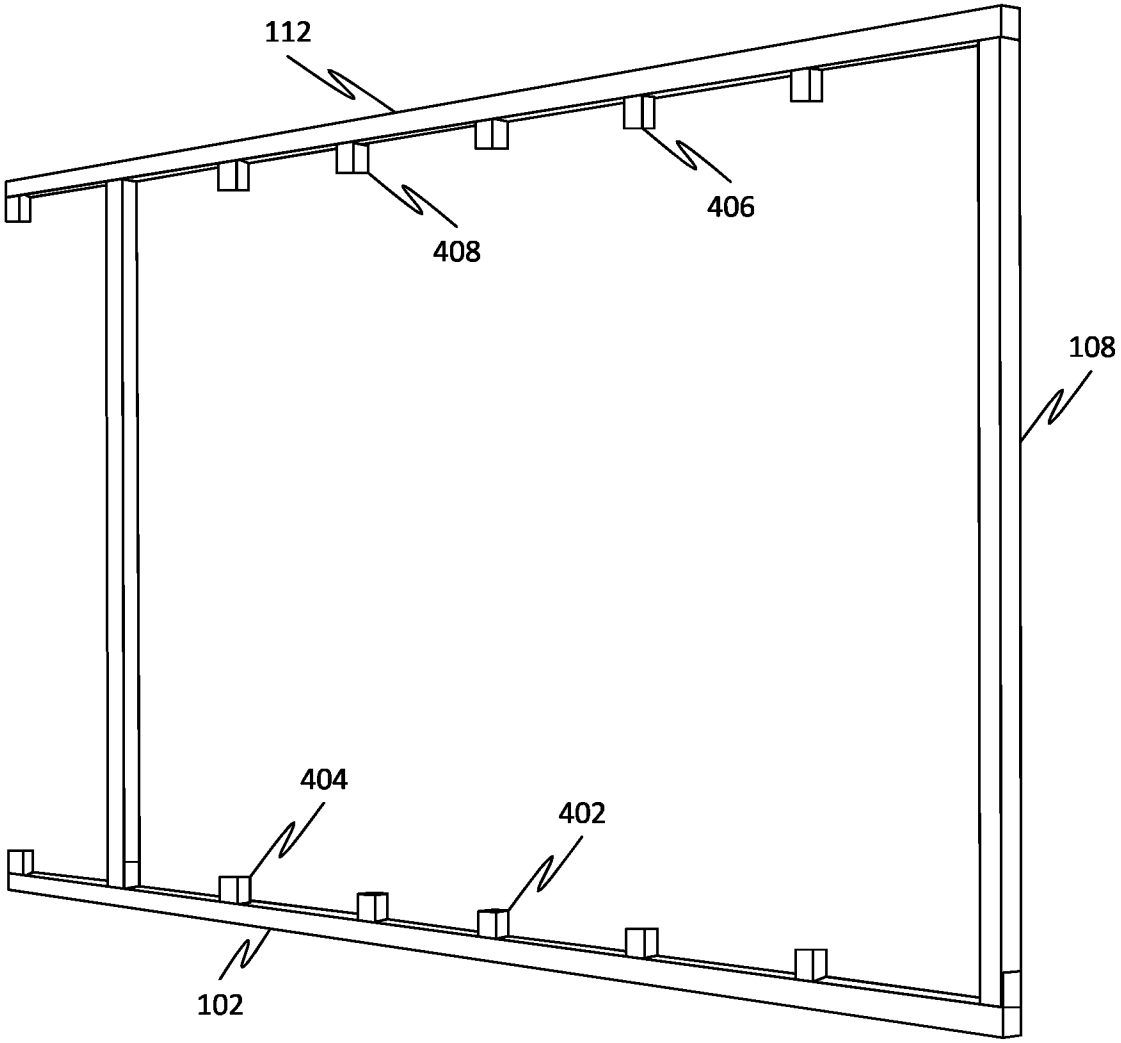
FIG. 4 is a front right side perspective view of the plurality of base protrusions and the plurality of top protrusions associated with the apparatus, in accordance with some embodiments.

Further, in some embodiments, the plurality of base couplers 202-204 may include a plurality of base protrusions 402-404 (as shown in FIG. 4). Further, each base protrusion of the plurality of base protrusions 402-404 may be characterized by a protrusion width and a protrusion height. Further, the protrusion width may be a measure of a spatial extension of a base protrusion 402 of the plurality of base protrusions 402-404 along a plane parallel to the at least one external upper base plate surface. Further, the protrusion height may be a measure of a spatial extension of a top protrusion 406 along a plane perpendicular to the at least one external upper base plate surface. Further, the lower stud end 128 may include a lower stud receptacle configured to receive the base protrusion 402 of the plurality of base protrusions 402-404. Further, the lower stud receptacle may be characterized by a receptacle depth and a receptacle width. Further, receptacle depth may be greater than the protrusion height. Further, the receptacle width may be greater than the protrusion width by a predetermined clearance. Further, the plurality of top couplers 206-208 may include a plurality of top protrusions 406-408 (as shown in FIG. 4). Further, the upper stud end 126 may include an upper stud receptacle configured to receive the top protrusion 406 of the plurality of top protrusions 406-408.

Figure 6:
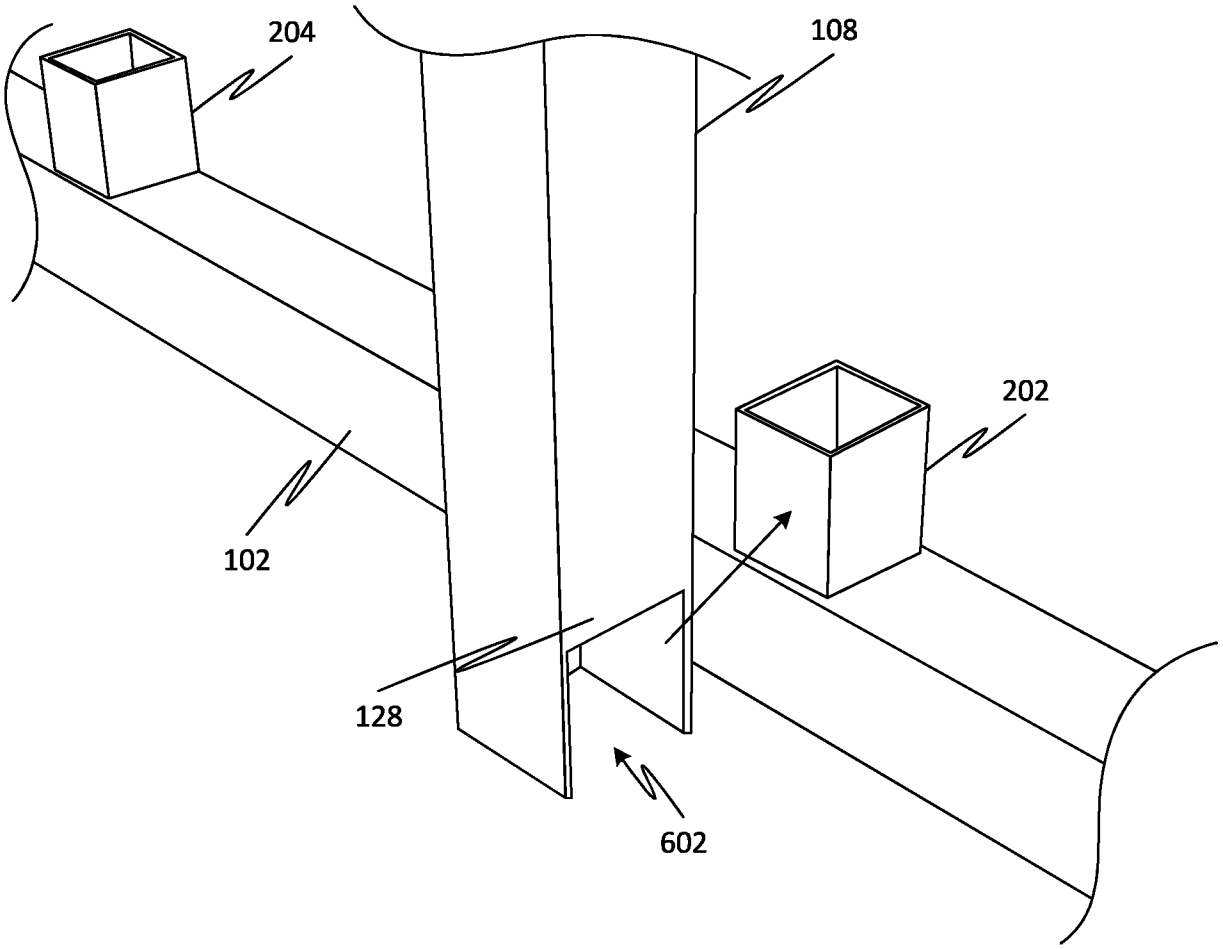
FIG. 6 is a partial top right perspective view of the base plate, the stud, and the cut-away opening, in accordance with some embodiments.

Further, in some embodiments, the elongated stud body 124 may include a hollow cuboidal body characterized by a stud width, a stud height, a stud length, and a stud thickness. Further, the lower stud end 128 may include a cut-away opening 602 (as shown in FIG. 6) on a first side of the hollow cuboidal body. Further, the cut-away opening 602 may be characterized by a cut-away width and a cut-away height. Further, the cut-away width may be greater than the protrusion width by the predetermined clearance. Further, the cut-away height may be greater than the protrusion height by the predetermined clearance.

Further, in some embodiments, the plurality of base plates 102-104 may include a first base plate and a second base plate. Further, the first base plate may include a first base plate end and a second base plate end. Further, the second base plate may include a third base plate end and a fourth base plate end. Further, the first base plate end may be configured to be detachably attached to the third base plate end.

Further, each of the plurality of base plates 102-104, the plurality of top plates 112-114, the plurality of studs 108-110, the plurality of rafters 130, and the plurality of braces 120-122 may include a plurality of apertures configured to receive at least a portion of the brace fastener in order to fasten any two of the base plate 102, the top plate 112, the stud 108 and the rafter 130 with each other.

Further, in some embodiments, the elongated brace body may include a cuboidal body 502 (as shown in FIG. 5) characterized by a width, a height, a length, and a thickness. Further, the left bracket 504 may include a rectangular plate characterized by a bracket width and a bracket length. Further, the left bracket 504 may be perpendicular to the left end of the elongated brace body. Further, each of the height of the cuboidal body 502 and the bracket length may be configured to snugly fit against a portion of at least one of the base plate 102, the top plate 112, the stud 108, and the rafter.

Further, in an embodiment, the apparatus 100 for a building frame designed to create a building is disclosed, in accordance with some embodiments. Accordingly, the apparatus 100 may include the plurality of base plates 102-104. Further, each base plate of the plurality of base plates 102-104 may include the elongated base plate body 106. Further, the elongated base plate body 106 may include the at least one external lower base plate surface configured to be placed in contact with the ground surface and the at least one external upper base plate surface opposed to the at least one external lower base plate surface.

Figure 7:
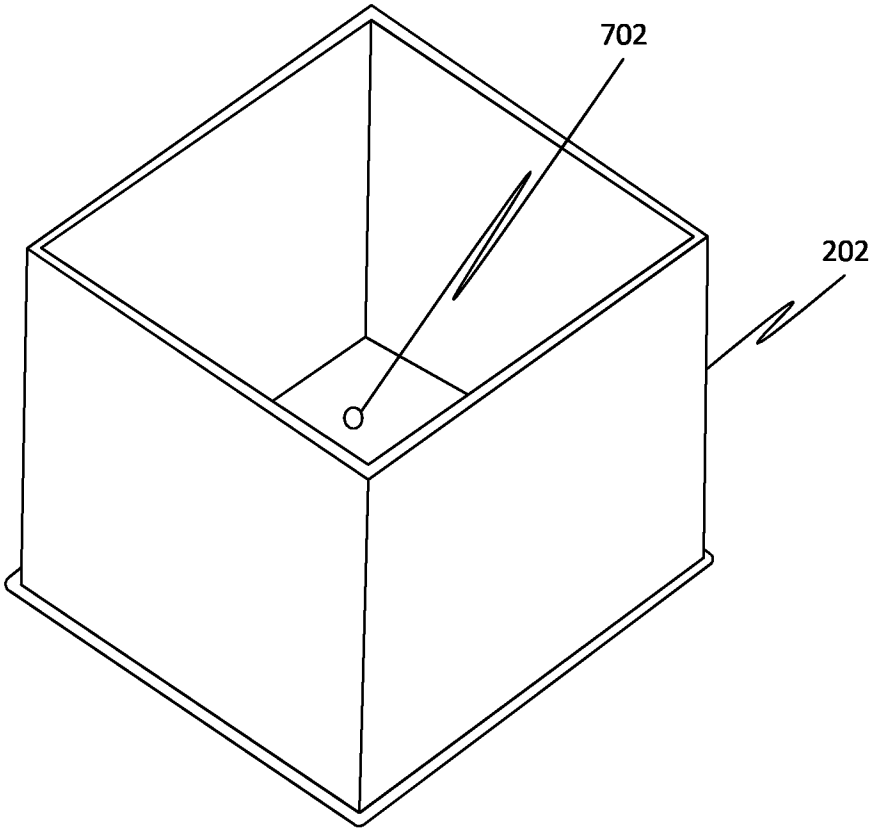
FIG. 7 is a front top perspective view of the base coupler with the base coupler aperture, in accordance with some embodiments.

Further, the apparatus 100 may include the plurality of base couplers 202-204 configured to be detachably attached along the length of the elongated base plate body 106 and on the at least one external upper base plate surface using a base coupler fastener. Further, each base coupler may be configured to be detachably attached with the lower stud end 128 of the stud 108. Further, each base coupler may include a base coupler aperture 702 (as shown in FIG. 7) configured to receive the base coupler fastener. Further, the at least one external upper base plate surface may include a base plate aperture configured to receive the base coupler fastener.

Further, the apparatus 100 may include the plurality of top plates 112-114. Further, each top plate of the plurality of top plates 112-114 may include the elongated top plate body may include at least one external lower top plate surface and at least one external upper top plate surface opposed to the at least one external lower top plate surface.

Further, the apparatus 100 may include the plurality of top couplers 206-208 configured to be detachably attached along a length of the elongated top plate body and on the at least one external lower top plate surface using a top coupler fastener. Further, each top coupler may be configured to be detachably attached with the upper stud end 126 of the stud 108. Further, each top coupler may include a top coupler aperture configured to receive the top coupler fastener. Further, the at least one external lower top plate surface may include a top plate aperture configured to receive the top coupler fastener.

Further, the apparatus 100 may include the plurality of studs 108-110. Further, each stud of the plurality of studs 108-110 may include the elongated stud body 124 having the upper stud end 126 and the lower stud end 128. Further, the upper stud end 126 may be configured to be detachably attached with the top coupler 206 of the plurality of top couplers 206-208. Further, the lower stud end 128 may be configured to be detachably attached with the base coupler 202 of the plurality of base couplers 202-204.

Further, the apparatus 100 may include the plurality of rafters 130. Further, each rafter of the plurality of rafters 130 may include the first slab body 116. Further, the first slab body 116 may include the first left slab surface and the first right slab surface opposing the first left slab surface. Further, the first slab body 116 may be characterized by the first slab length, the first slab height, and the first slab width. Further, the each rafter may include the first cuboidal body 118 may include the first left cuboidal surface and the first right cuboidal surface opposing the first left cuboidal surface. Further, the first right cuboidal surface may be attached to the first left slab surface along the upper boundary of the first left slab surface. Further, the first cuboidal body 118 may be characterized by the first cuboidal width, the first cuboidal height, and the first cuboidal length. Further, the first slab height may be greater than the first cuboidal height by the predetermined ratio. Further, the first cuboidal length may be greater than the first slab length by the predetermined extent. Further, the extended portion of the first cuboidal body 118 equally extends out on either side of the first slab body 116 according to the predetermined extent. Further, the first right cuboidal surface corresponding to the extended portion may not be juxtaposed with the first left slab surface.

Further, the apparatus 100 may include the plurality of braces 120-122 corresponding to the plurality of brace lengths. Further, each brace may include the elongated brace body characterized by the corresponding brace length, the left bracket 504 attached to and extending from the left end of the elongated brace body, and the right bracket 506 attached to and extending from the right end of the elongated brace body. Further, each brace may be configured to fasten any two of the base plate 102, the top plate 112, the stud 108, and the rafter 130 with each other using the brace fastener.

Further, in an embodiment, the apparatus 100 for a building frame designed to create a building is disclosed, in accordance with some embodiments. Accordingly, the apparatus 100 may include the plurality of base plates 102-104. Further, each base plate of the plurality of base plates 102-104 may include the elongated base plate body 106. Further, the elongated base plate body 106 may include the at least one external lower base plate surface configured to be placed in contact with the ground surface and the at least one external upper base plate surface opposed to the at least one external lower base plate surface. Further, the each base plate may include the plurality of base couplers 202-204 disposed along the length of the elongated base plate body 106 and on the at least one external upper base plate surface. Further, each base coupler may be configured to be detachably attached with the lower stud end 128 of the stud 108. Further, the plurality of base couplers 202-204 may include the plurality of base protrusions 402-404. Further, each base protrusion may be characterized by the protrusion width and the protrusion height. Further, the lower stud end 128 may include the lower stud receptacle configured to receive the base protrusion 402 of the plurality of base protrusions 402-404. Further, the lower stud receptacle may be characterized by the receptacle depth and the receptacle width. Further, the receptacle depth may be greater than the protrusion height. Further, the receptacle width may be greater than the protrusion width by the predetermined clearance. Further, the plurality of top couplers 206-208 may include the plurality of top protrusions 406-408. Further, the upper stud end 126 may include the upper stud receptacle configured to receive the top protrusion 406 of the plurality of top protrusions 406-408. Further, the elongated stud body 124 may include the hollow cuboidal body characterized by the stud width, the stud height, the stud length, and the stud thickness. Further, the lower stud end 128 may include the cut-away opening 602 on the first side of the hollow cuboidal body. Further, the cut-away opening 602 may be characterized by the cut-away width and the cut-away height. Further, the cut-away width may be greater than the protrusion width by the predetermined clearance. Further, the cut-away height may be greater than the protrusion height by the predetermined clearance.

Further, the apparatus 100 may include the plurality of top plates 112-114. Further, each top plate of the plurality of top plates 112-114 may include the elongated top plate body. Further, the elongated top plate body may include the at least one external lower top plate surface and the at least one external upper top plate surface opposed to the at least one external lower top plate surface. Further, the each top plate may include the plurality of top couplers 206-208 disposed along the length of the elongated top plate body and on the at least one external lower top plate surface. Further, each top coupler may be configured to be detachably attached with the upper stud end 126 of the stud 108.

Further, the apparatus 100 may include the plurality of studs 108-110. Further, each stud of the plurality of studs 108-110 may include the elongated stud body 124 having the upper stud end 126 and the lower stud end 128. Further, the upper stud end 126 may be configured to be detachably attached with the top coupler 206 of the plurality of top couplers 206-208. Further, the lower stud end 128 may be configured to be detachably attached with the base coupler 202 of the plurality of base couplers 202-204.

Further, the apparatus 100 may include the plurality of rafters 130. Further, each rafter of the plurality of rafters 130 may include the first slab body 116. Further, the first slab body 116 may include the first left slab surface and the first right slab surface opposing the first left slab surface. Further, the first slab body 116 may be characterized by a first slab length, a first slab height, and a first slab width. Further, the each rafter may include the first cuboidal body 118. Further, the first cuboidal body 118 may include the first left cuboidal surface and the first right cuboidal surface opposing the first left cuboidal surface. Further, the first right cuboidal surface may be attached to the first left slab surface along an upper boundary of the first left slab surface. Further, the first cuboidal body 118 may be characterized by a first cuboidal width, a first cuboidal height, and a first cuboidal length. Further, the first slab height may be greater than the first cuboidal height by a predetermined ratio. Further, the first cuboidal length may be greater than the first slab length by the predetermined extent. Further, an extended portion of the first cuboidal body 118 equally extends out on either side of the first slab body 116 according to the predetermined extent. Further, the first right cuboidal surface corresponding to the extended portion may not be juxtaposed with the first left slab surface.

Further, the apparatus 100 may include the plurality of braces 120-122 corresponding to the plurality of brace lengths. Further, each brace may include the elongated brace body characterized by the corresponding brace length, the left bracket 504 attached to and extending from the left end of the elongated brace body, and the right bracket 506 attached to and extending from the right end of the elongated brace body. Further, each brace may be configured to fasten any two of the base plate 102, the top plate 112, the stud 108, and the rafter 130 with each other using the brace fastener.

Further, in some embodiments, the plurality of base couplers 202-204 may be disposed equidistantly on the base plate 102. Further, the plurality of top couplers 206-208 may be disposed equidistantly on the top plate 112. Further, the base plate length of the base plate may be identical to the top plate length of the top plate 112. Further, aligning the first base plate end of the base plate 102 with the first top plate end of the top plate 112 and aligning the second base plate end of the base plate 102 with the second top plate end of the top plate 112 results in an alignment of the plurality of top couplers 206-208 with the plurality of base couplers 202-204.

Further, in some embodiments, the each rafter may include the second slab body 302. Further, the second slab body 302 may include the second left slab surface and the second right slab surface opposing the second left slab surface. Further, the second slab body 302 may be characterized by the second slab length, the second slab height, and the second slab width. Further, the each rafter may include the second cuboidal body 304. Further, the second cuboidal body 304 may include the second left cuboidal surface and the second right cuboidal surface opposing the second left cuboidal surface. Further, the second right cuboidal surface may be attached to the first left slab surface along the lower boundary of the first left slab surface. Further, the second left cuboidal surface may be attached to the second right slab surface along the lower boundary of the second right slab surface. Further, the second cuboidal body 304 may be characterized by the second cuboidal width, the second cuboidal height, and the second cuboidal length. Further, the first slab height may be greater than the second cuboidal height by the predetermined ratio. Further, the second cuboidal length may be identical to the first slab length. Further, the second cuboidal body 304 may be attached the first cuboidal body 118 through the plurality of blocks 306-308.

Further, the each rafter may include the plurality of blocks 306-308. Further, each block may include the left block surface, the right block surface, the bottom block surface, and the top block surface. Further, the right block surface may be attached to the first left slab surface. Further, the left block surface may be attached to the second right slab surface. Further, the top block surface may be attached to the first lower cuboidal surface. Further, the lower block surface may be attached to the second upper cuboidal surface.

Further, in some embodiments, the elongated brace body may include the cuboidal body 502 characterized by the width, the height, the length, and the thickness. Further, the left bracket 504 may include the rectangular plate characterized by the bracket width and the bracket length. Further, the left bracket 504 may be perpendicular to the left end of the elongated brace body. Further, each of the height of the cuboidal body and the bracket length may be configured to snugly fit against the portion of at least one of the base plate 102, the top plate 112, the stud 108, and the rafter.

Further, in some embodiments, each of the upper stud end 126 of the stud 108 and the top coupler 206 may be configured to be detachably attached with each other without any fastener. Further, each of the lower stud end 128 and the base coupler 202 may be configured to be detachably attached with each other without any fastener.

Further, the apparatus 100 may be associated with at least one quality. Further, the at least one quality may include fireproof, termite-proof, etc. Further, the apparatus 100 may be made up of galvanized square tube steel.

FIG. 2 is a top right side perspective view of a wall associated with the apparatus 100, in accordance with some embodiments.

FIG. 3 is a bottom right side perspective view of the rafter 130 of the plurality of rafters 130, in accordance with some embodiments.

FIG. 4 is a front right side perspective view of the plurality of base protrusions 402-404 and the plurality of top protrusions 406-408 associated with the apparatus 100, in accordance with some embodiments.

FIG. 5 is a side view of the plurality of braces 120-122 associated with the apparatus 100, in accordance with some embodiments. Accordingly, the plurality of braces 120-122 may be associated with a plurality of sizes.

FIG. 6 is a partial top right perspective view of the base plate 102, the stud 108, and the cut-away opening 602, in accordance with some embodiments.

FIG. 7 is a front top perspective view of the base coupler 202 with the base coupler aperture 702, in accordance with some embodiments.

Figure 8:
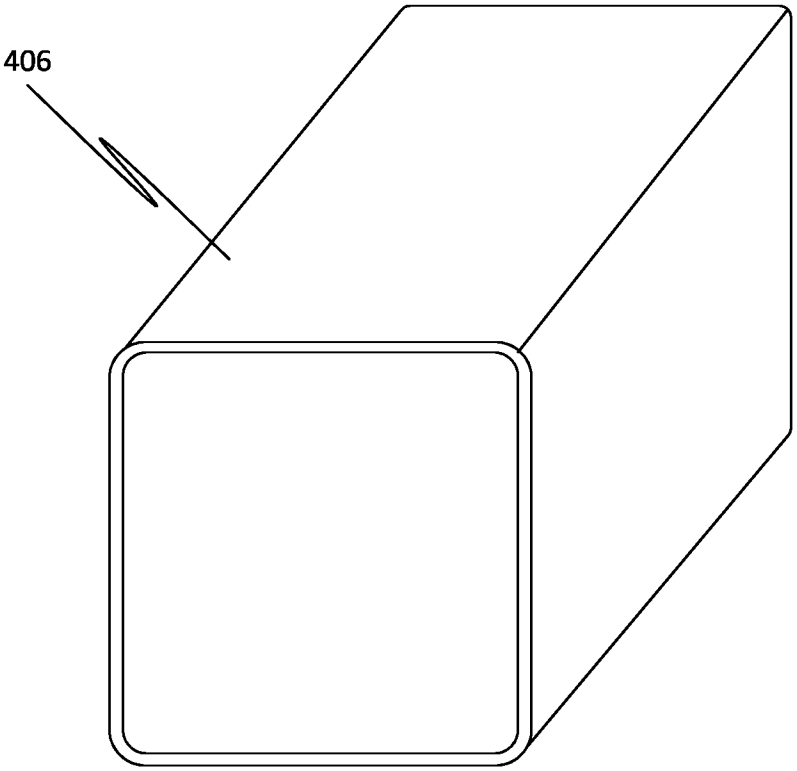
FIG. 8 is a top right side perspective view of the top protrusion of the plurality of top protrusions, in accordance with some embodiments.

FIG. 8 is a top right side perspective view of the top protrusion 406 of the plurality of top protrusions 406-408, in accordance with some embodiments.

Figure 9:
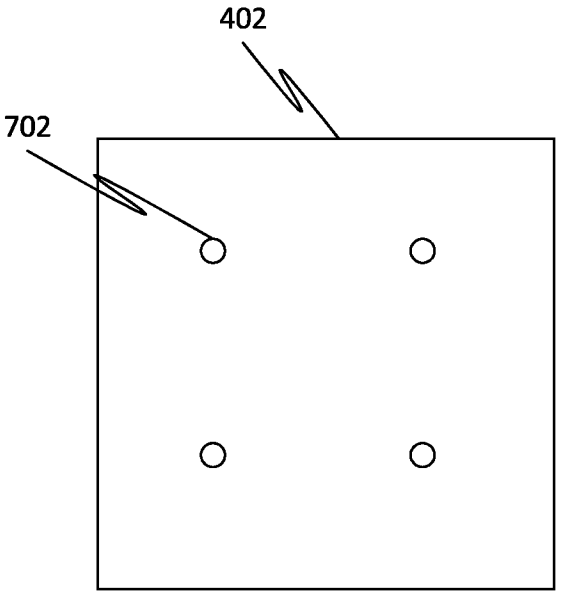
FIG. 9 is a bottom view of the base coupler aperture of the base protrusion of the plurality of base protrusions, in accordance with some embodiments.

FIG. 9 is a bottom view of the base coupler aperture 702 of the base protrusion 402 of the plurality of base protrusions 402-404, in accordance with some embodiments.

Figure 10:
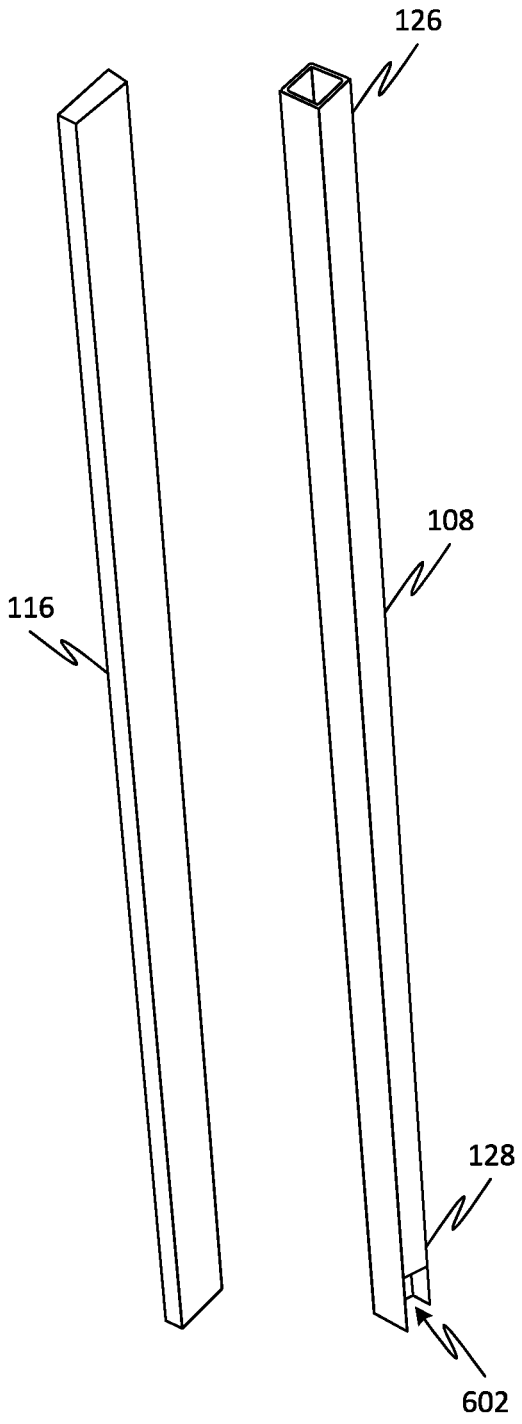
FIG. 10 is a right side perspective view of the stud and the first slab body, in accordance with some embodiments.

FIG. 10 is a right side perspective view of the stud 108 and the first slab body 116, in accordance with some embodiments.

Figure 11:
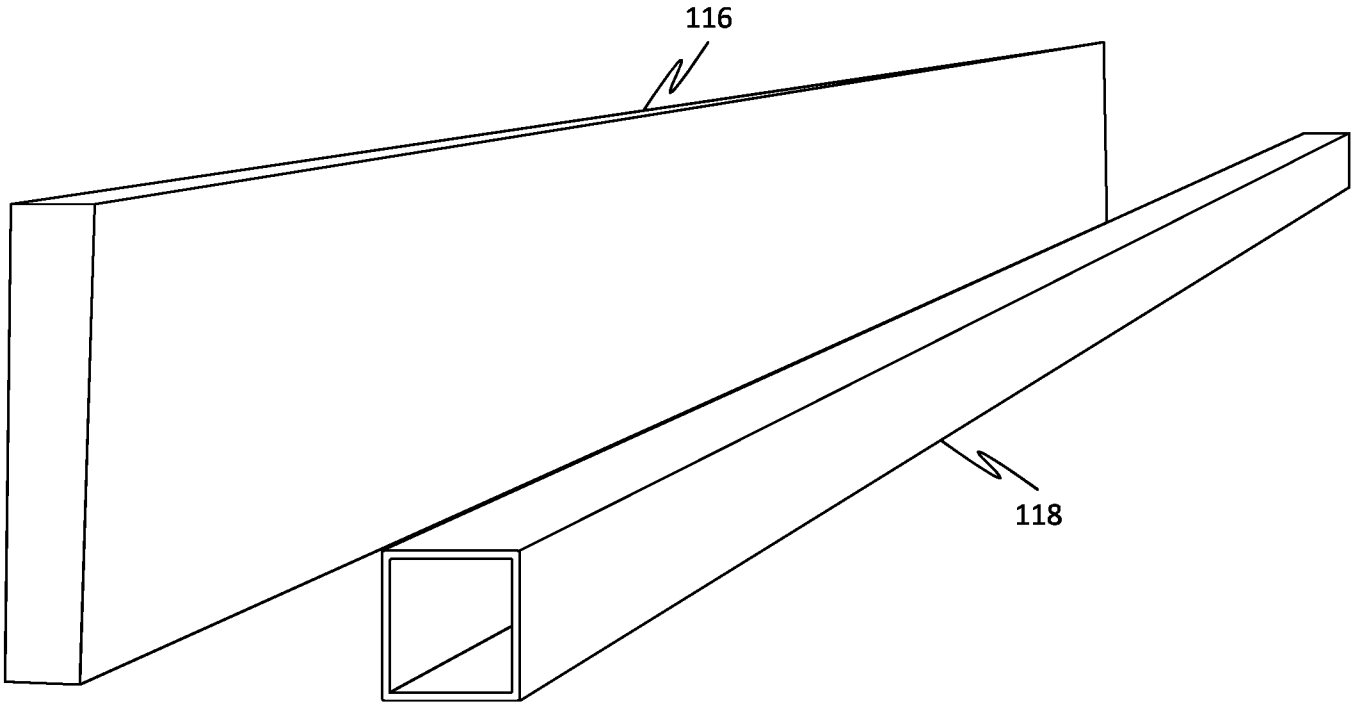
FIG. 11 is a left side perspective view of the first slab body and the first cuboidal body, in accordance with some embodiments.

FIG. 11 is a left side perspective view of the first slab body 116 and the first cuboidal body 118, in accordance with some embodiments.

Figure 12:
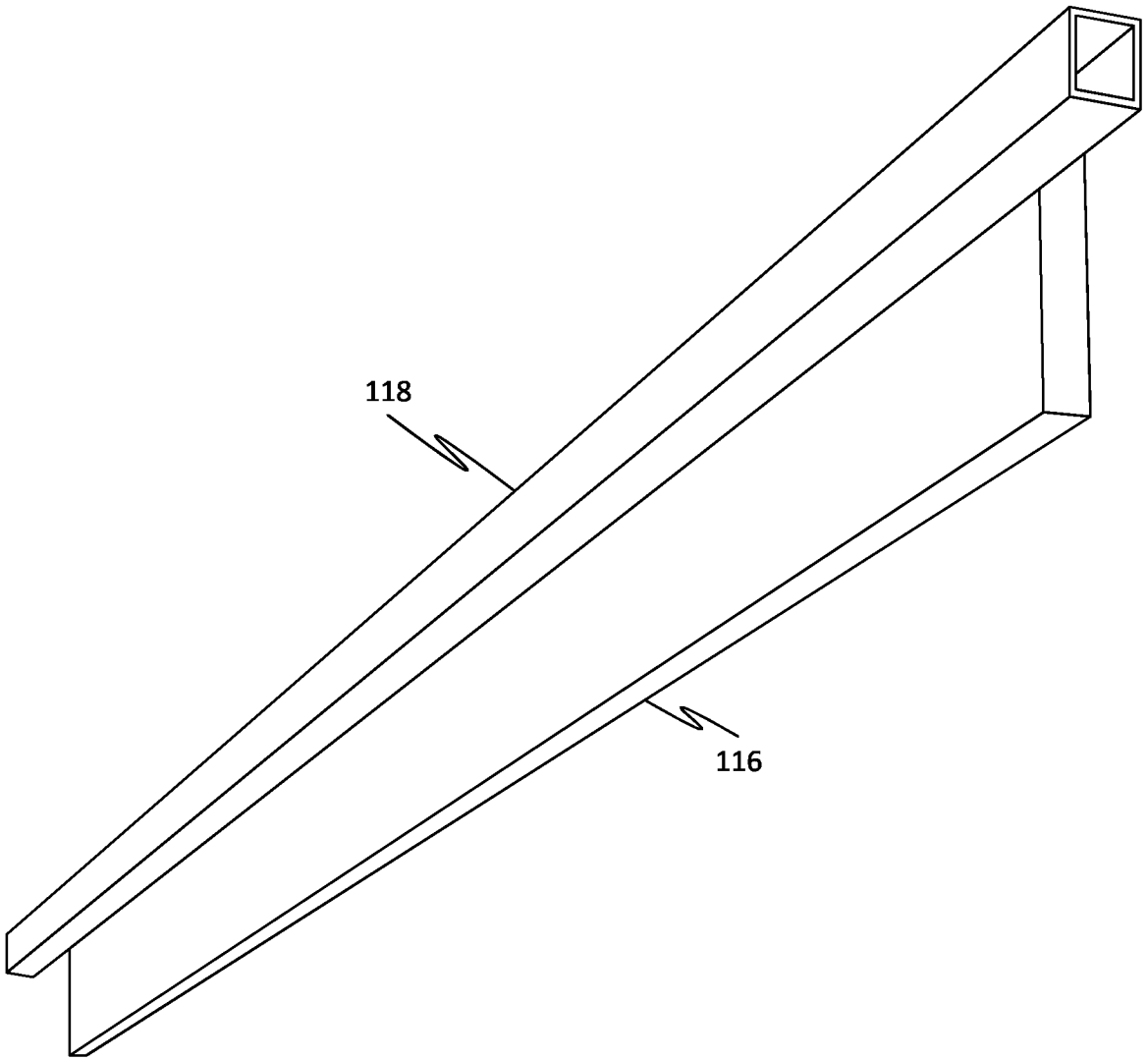
FIG. 12 is a bottom right side perspective view of the rafter of the plurality of rafters, in accordance with some embodiments.

FIG. 12 is a bottom right side perspective view of the rafter 130 of the plurality of rafters 130, in accordance with some embodiments.

Figure 13:
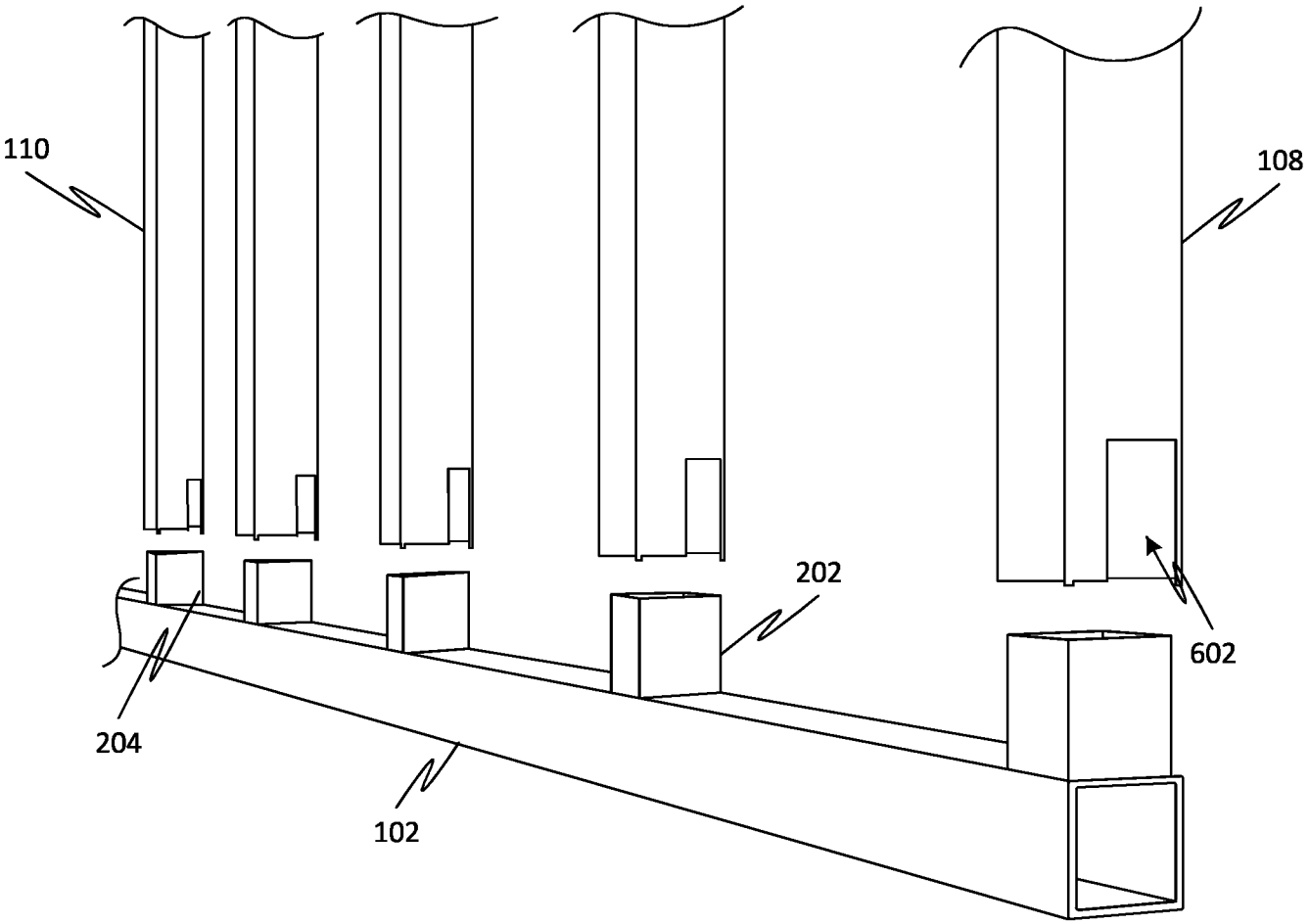
FIG. 13 is a partial front right side perspective view of the base plate with the plurality of studs, in accordance with some embodiments.

FIG. 13 is a partial front right side perspective view of the base plate 102 with the plurality of studs 108-110, in accordance with some embodiments.

Figure 14:
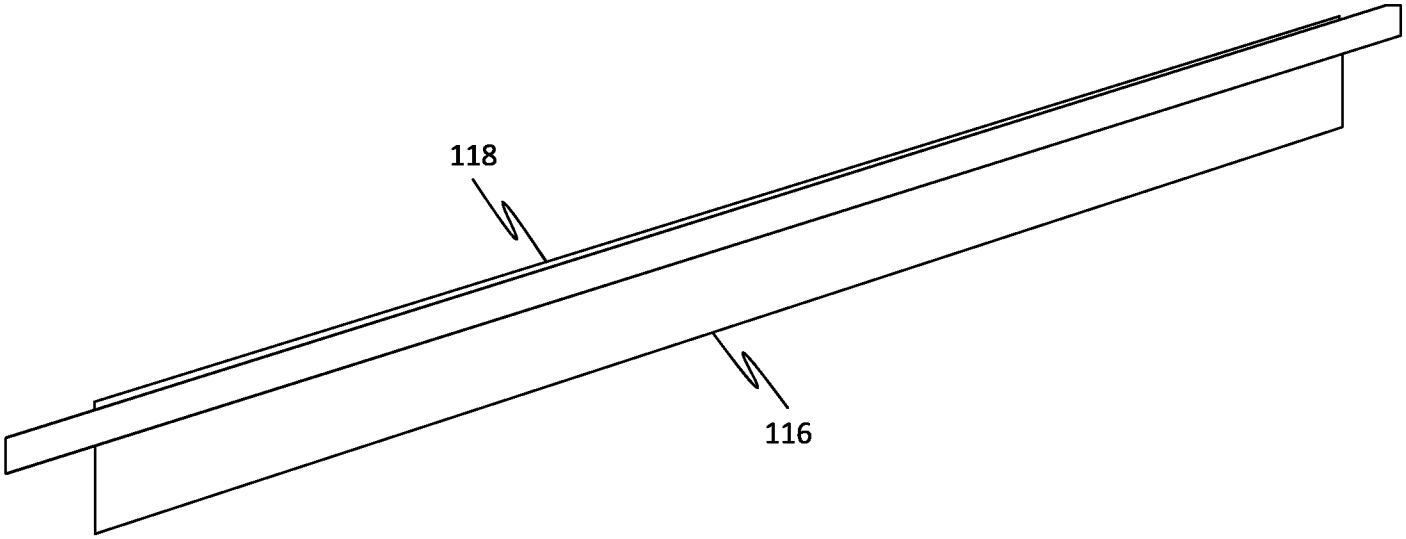
FIG. 14 is a top left side perspective view of the rafter of the plurality of rafters, in accordance with some embodiments.

FIG. 14 is a top left side perspective view of the rafter 130 of the plurality of rafters 130, in accordance with some embodiments.

Figure 15:
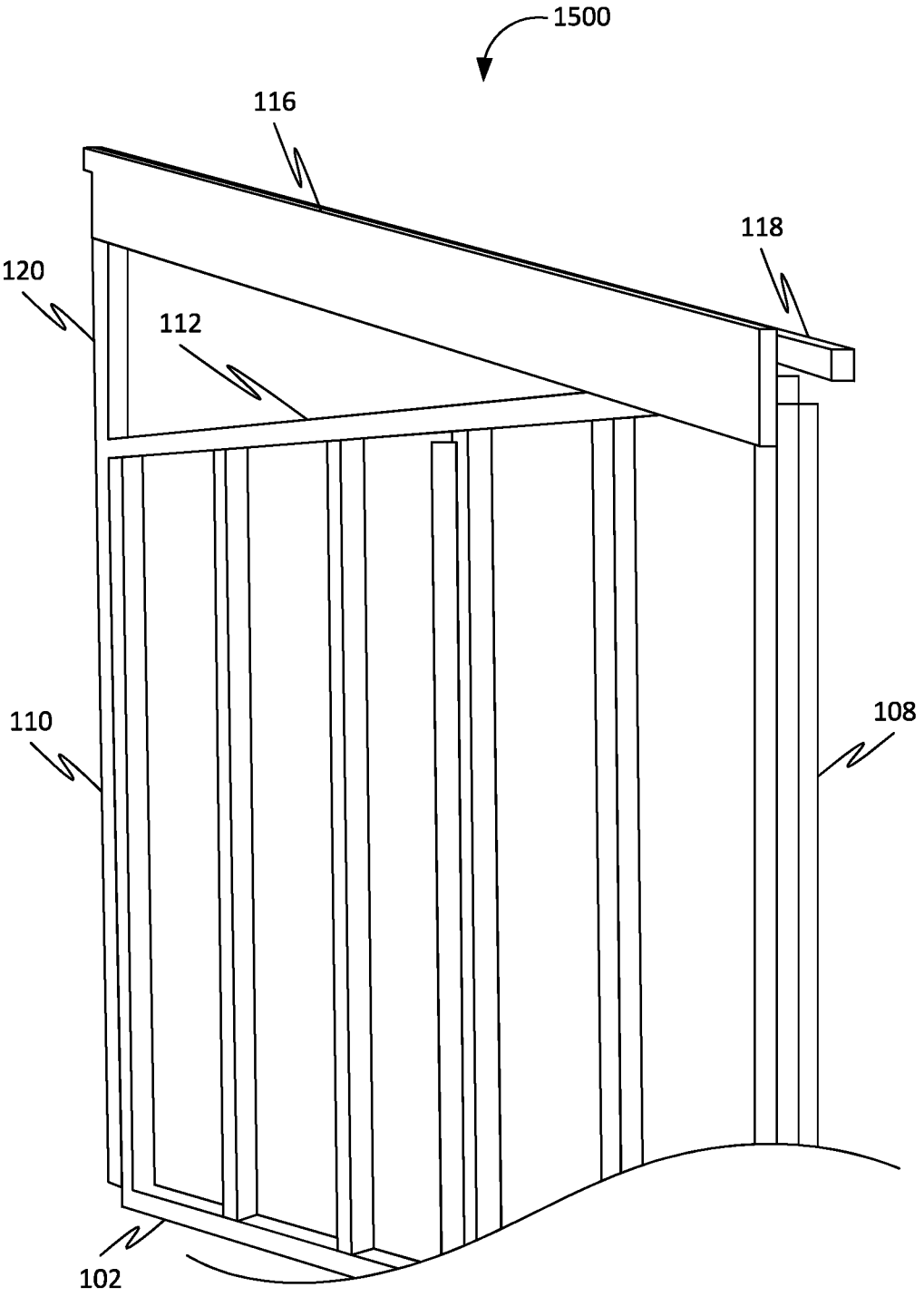
FIG. 15 is a partial front right side perspective view of a building frame created by the apparatus, in accordance with some embodiments.

FIG. 15 is a partial front right side perspective view of a building frame 1500 created by the apparatus 100, in accordance with some embodiments.

Figure 16:
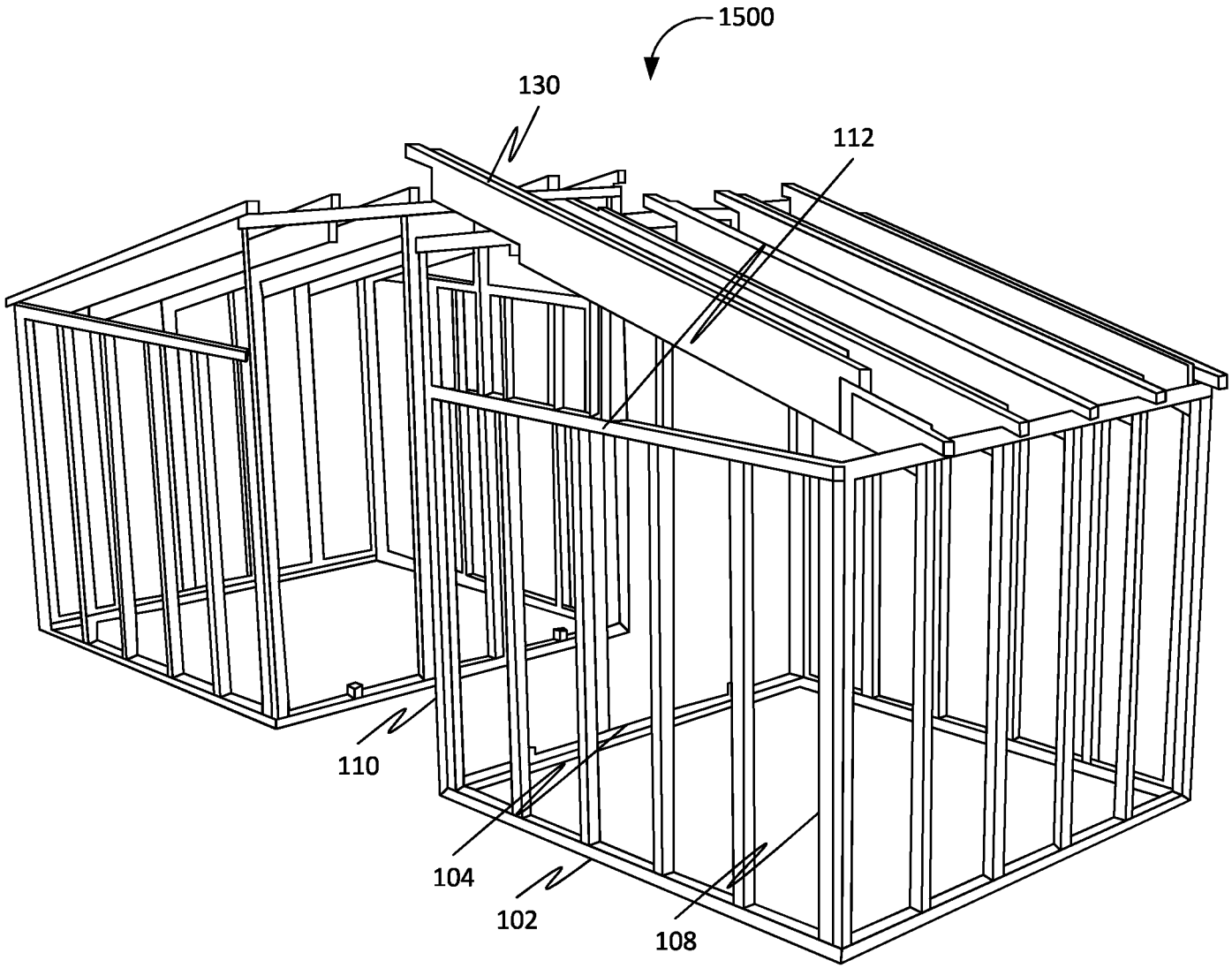
FIG. 16 is a front right side perspective view of the building frame created by the apparatus, in accordance with some embodiments.

FIG. 16 is a front right side perspective view of the building frame 1500 created by the apparatus 100, in accordance with some embodiments.

Figure 17:
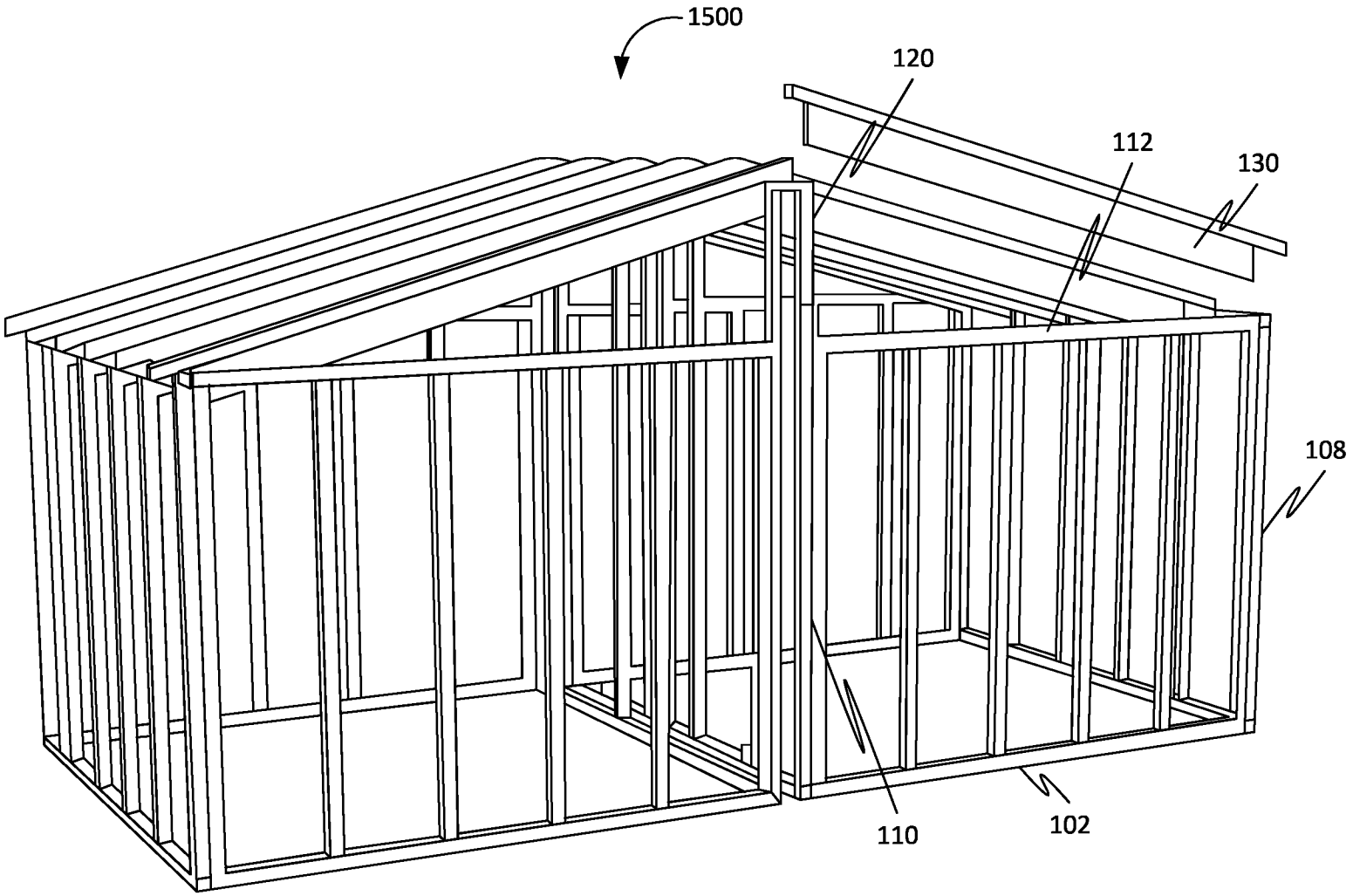
FIG. 17 is a front left side perspective view of the building frame created by the apparatus, in accordance with some embodiments.

FIG. 17 is a front left side perspective view of the building frame 1500 created by the apparatus 100, in accordance with some embodiments.

Figure 18:
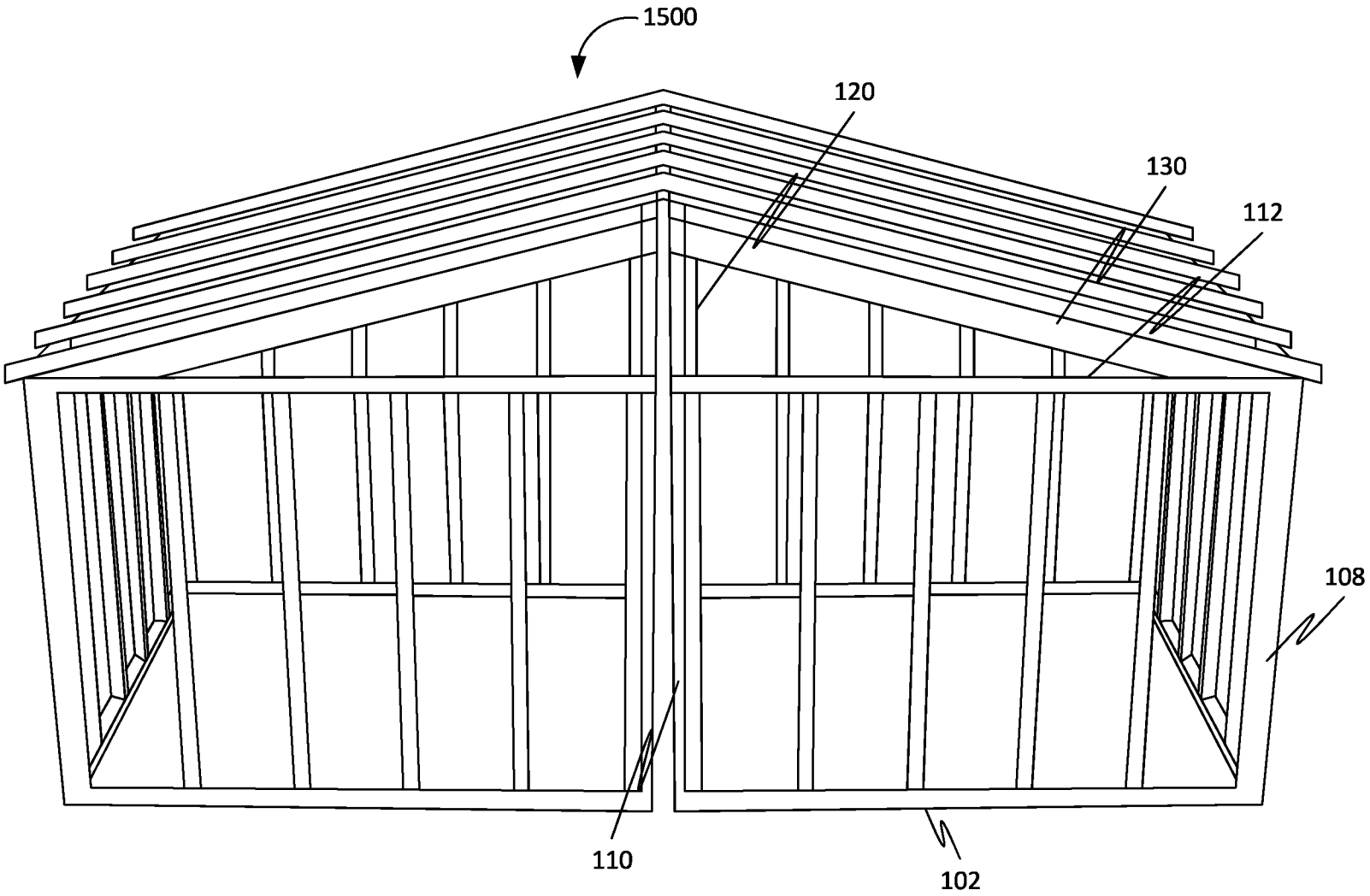
FIG. 18 is a front top perspective view of the building frame created by the apparatus, in accordance with some embodiments.

FIG. 18 is a front top perspective view of the building frame 1500 created by the apparatus 100, in accordance with some embodiments.

Figure 19:
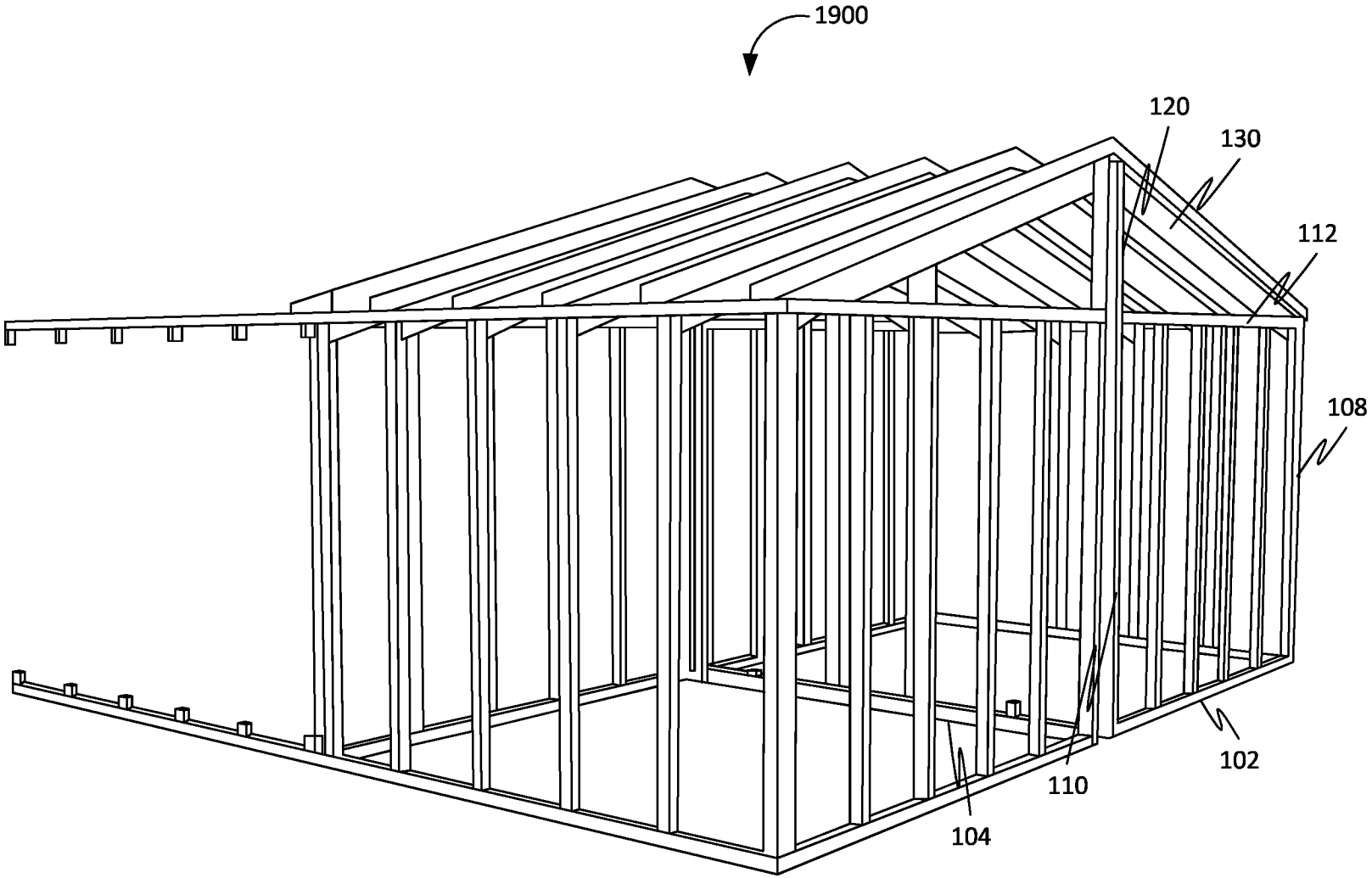
FIG. 19 is a front left side perspective view of a building frame created by the apparatus, in accordance with some embodiments.

FIG. 19 is a front left side perspective view of a building frame 1900 created by the apparatus 100, in accordance with some embodiments.

Figure 20:
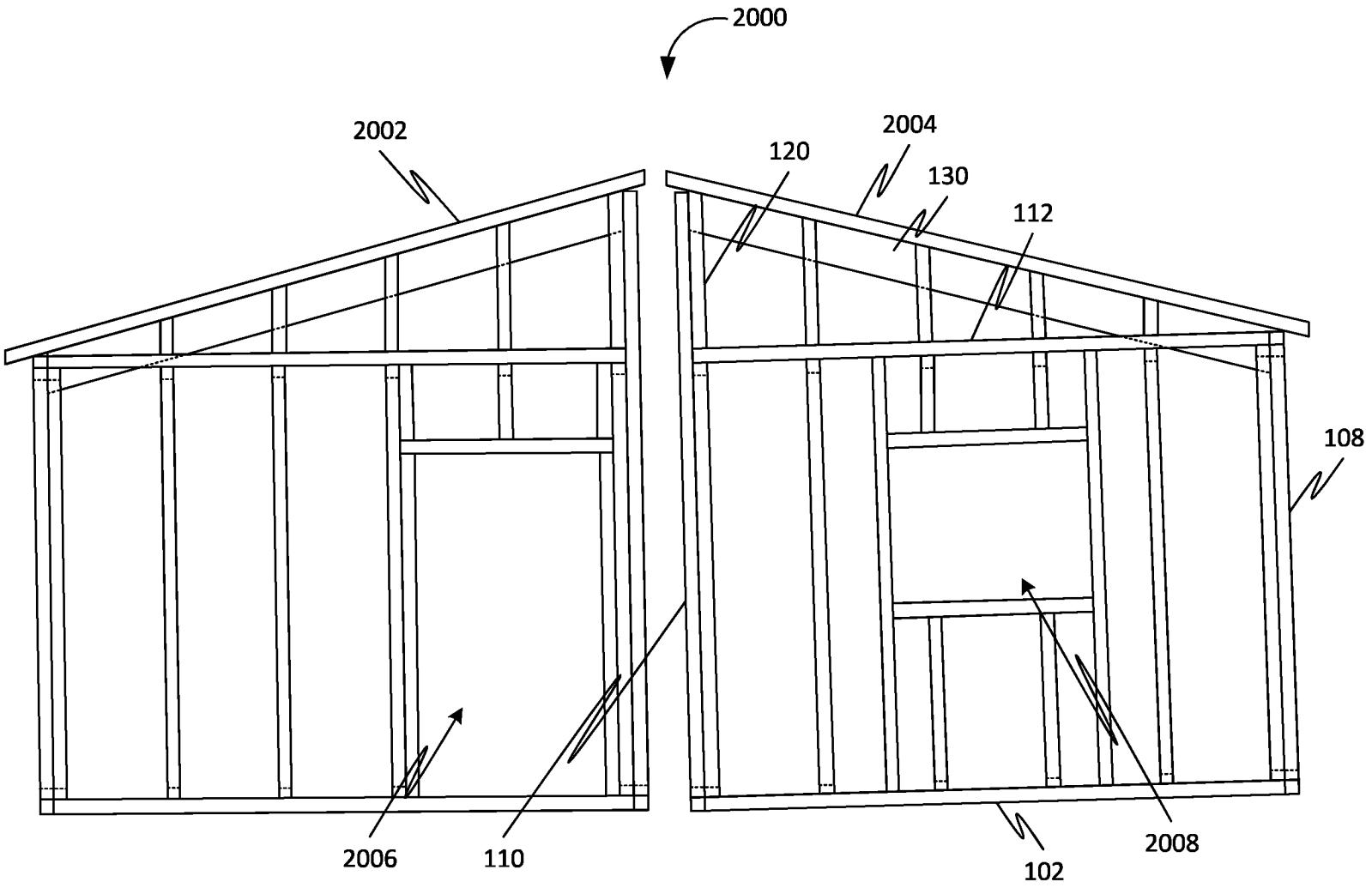
FIG. 20 is a front view of a building frame created by the apparatus, in accordance with some embodiments.

FIG. 20 is a front view of a building frame 2000 created by the apparatus 100, in accordance with some embodiments. Accordingly, the building frame 2000 may include a left unit 2002 and a right unit 2004. Further, the left unit 2002 may include a door opening 2006 and the right unit 2004 may include a window opening 2008.

Figure 21:
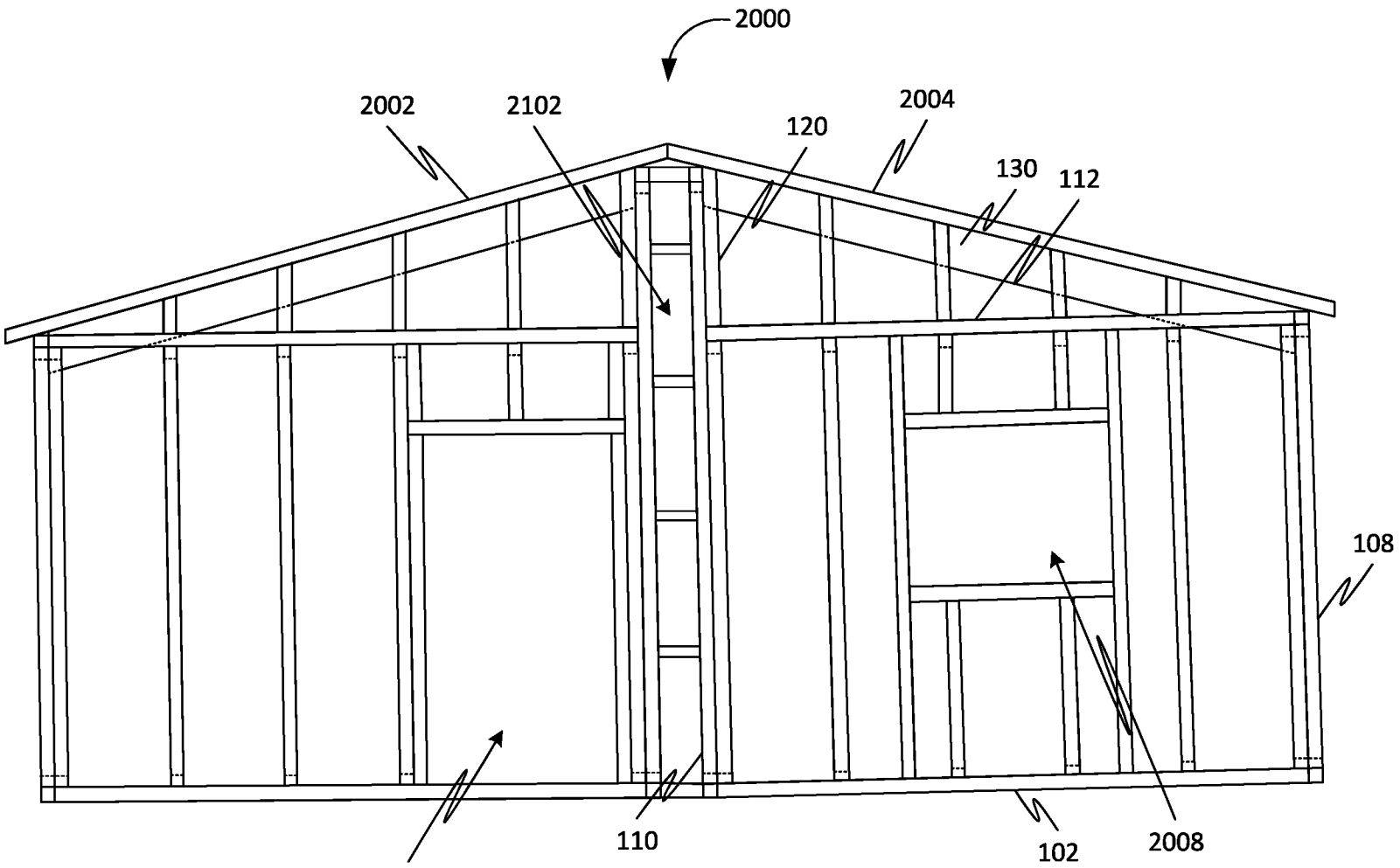
FIG. 21 is a front view of the building frame, in accordance with some embodiments.

FIG. 21 is a front view of the building frame 2000, in accordance with some embodiments. Accordingly, the right unit 2004 and the left unit 2002 may be attached to each other using a center wall component 2102 associated with the building frame 2000.

Figure 22:
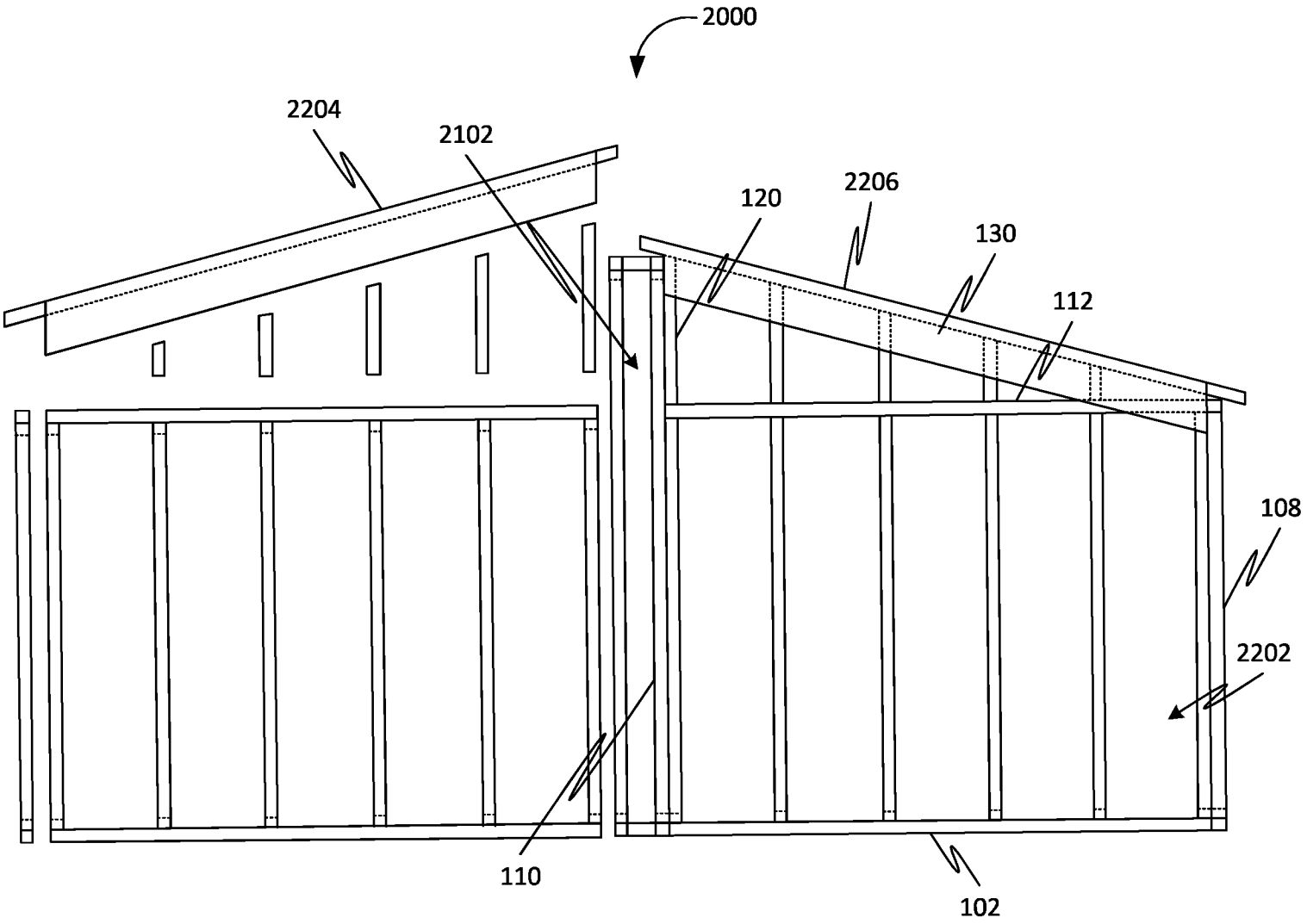
FIG. 22 is a front view of at least one interior wall associated with the building frame, in accordance with some embodiments.

FIG. 22 is a front view of at least one interior wall 2202 associated with the building frame 2000, in accordance with some embodiments. Accordingly, an interior left unit 2204 of the at least one interior wall 2202 may be attached to an interior right unit 2206 of the at least one interior wall 2202 using the center wall component 2102.

Figure 23:
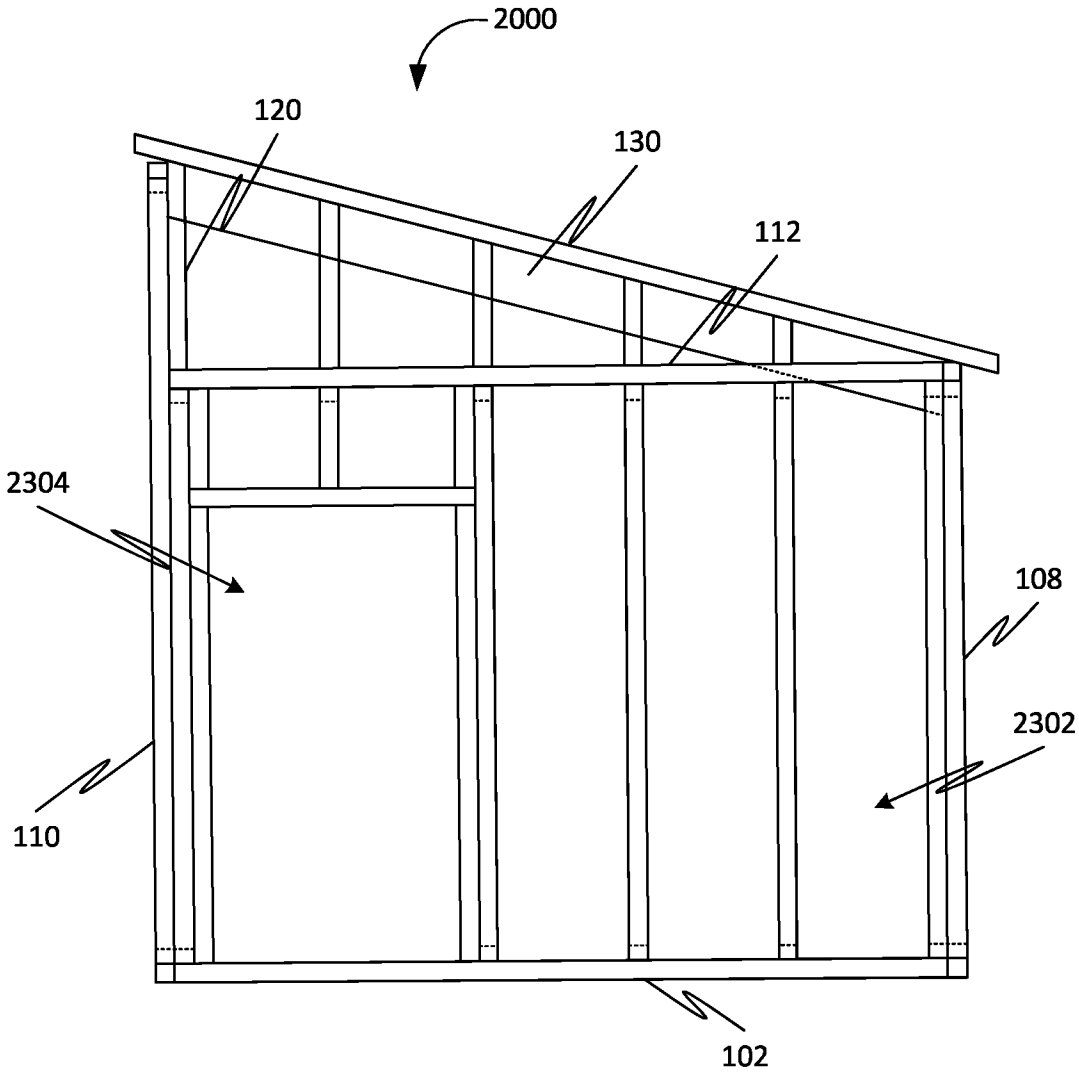
FIG. 23 is a front view of a back wall associated with the building frame, in accordance with some embodiments.

FIG. 23 is a front view of a back wall 2302 associated with the building frame 2000, in accordance with some embodiments. Accordingly, the back wall 2302 may include a door opening 2304.

Figure 24:
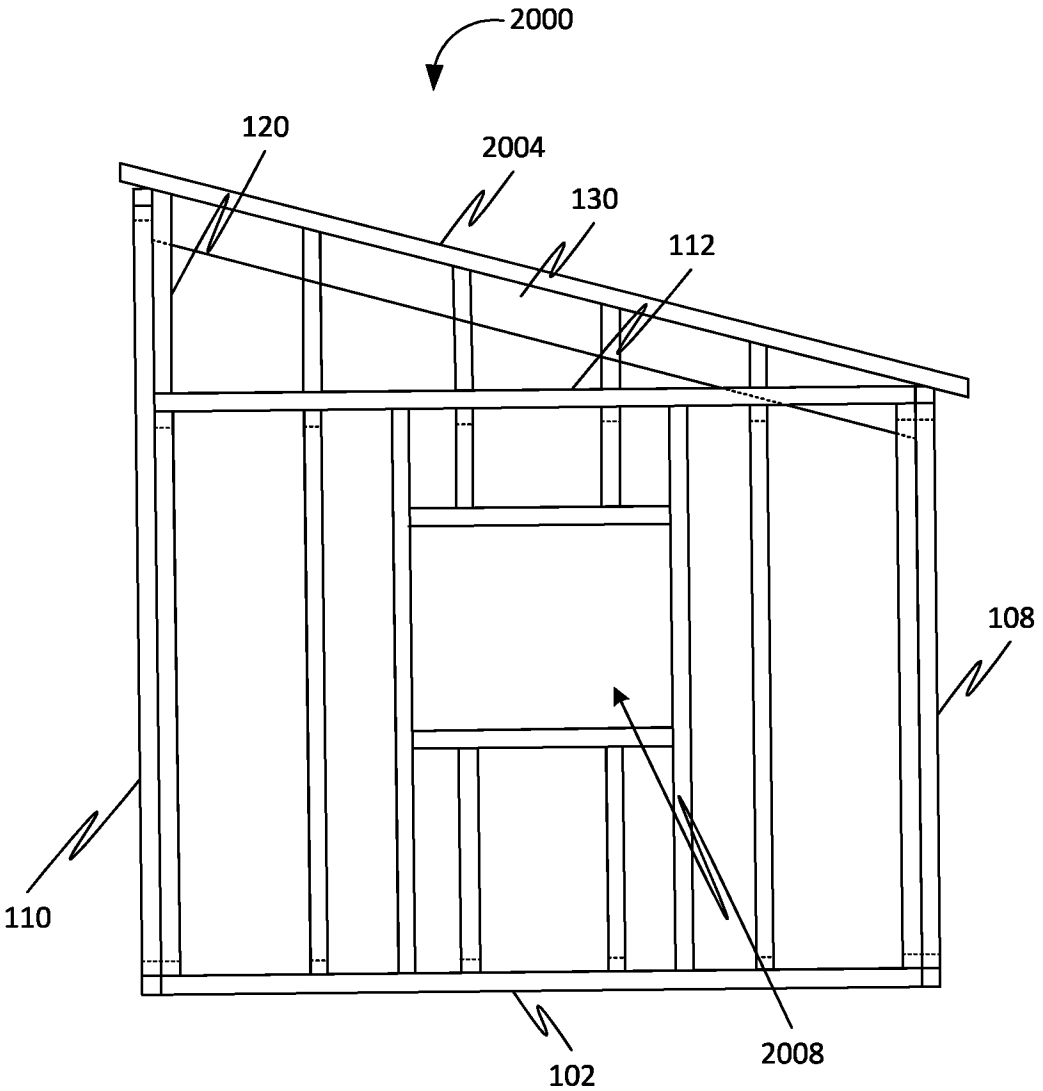
FIG. 24 is a front view of the right unit building frame, in accordance with some embodiments.

FIG. 24 is a front view of the right unit 2004 building frame 2000, in accordance with some embodiments.

Figure 25:
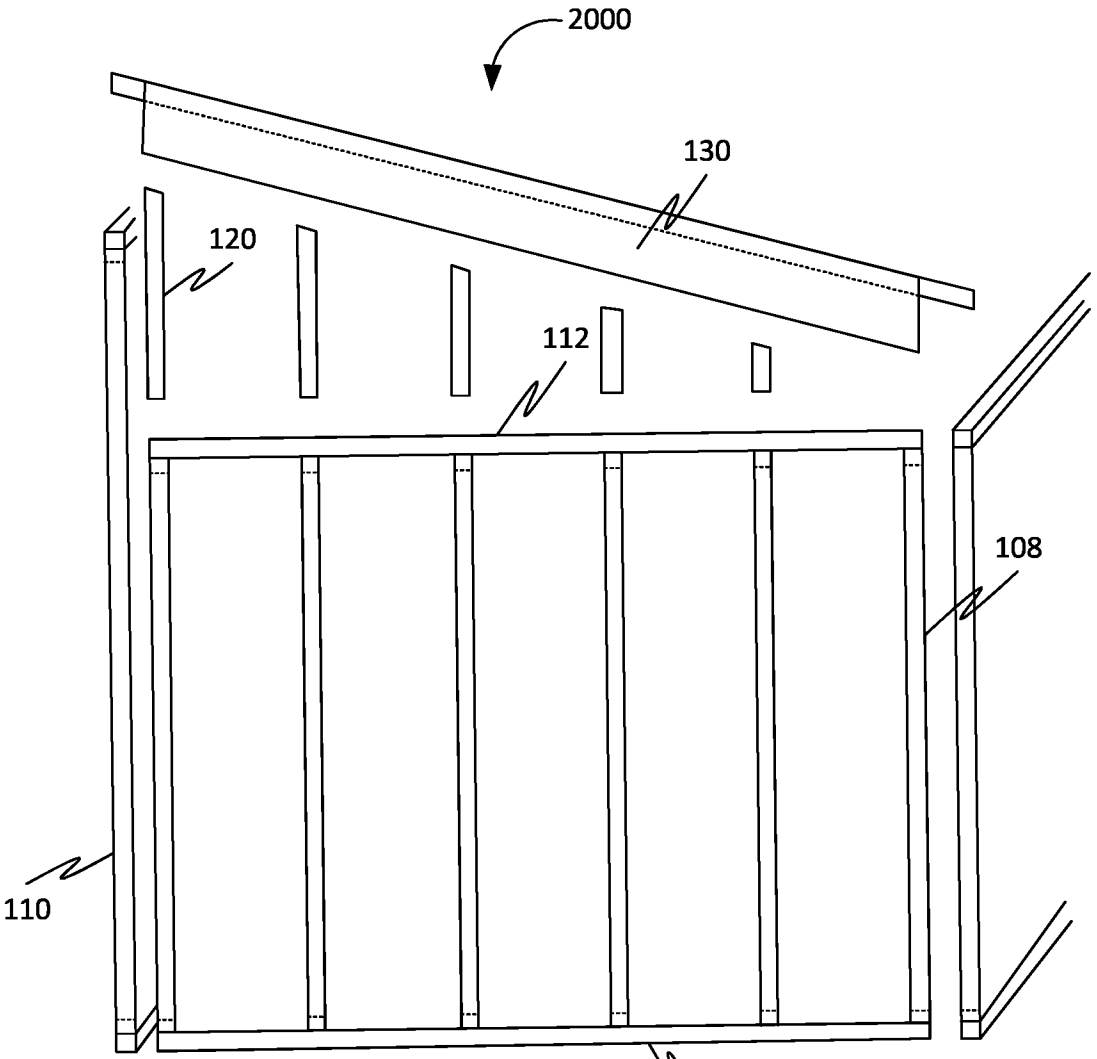
FIG. 25 is an exploded view of the interior right unit of at least one internal blank wall of the building frame, in accordance with some embodiments.
Figure 26:
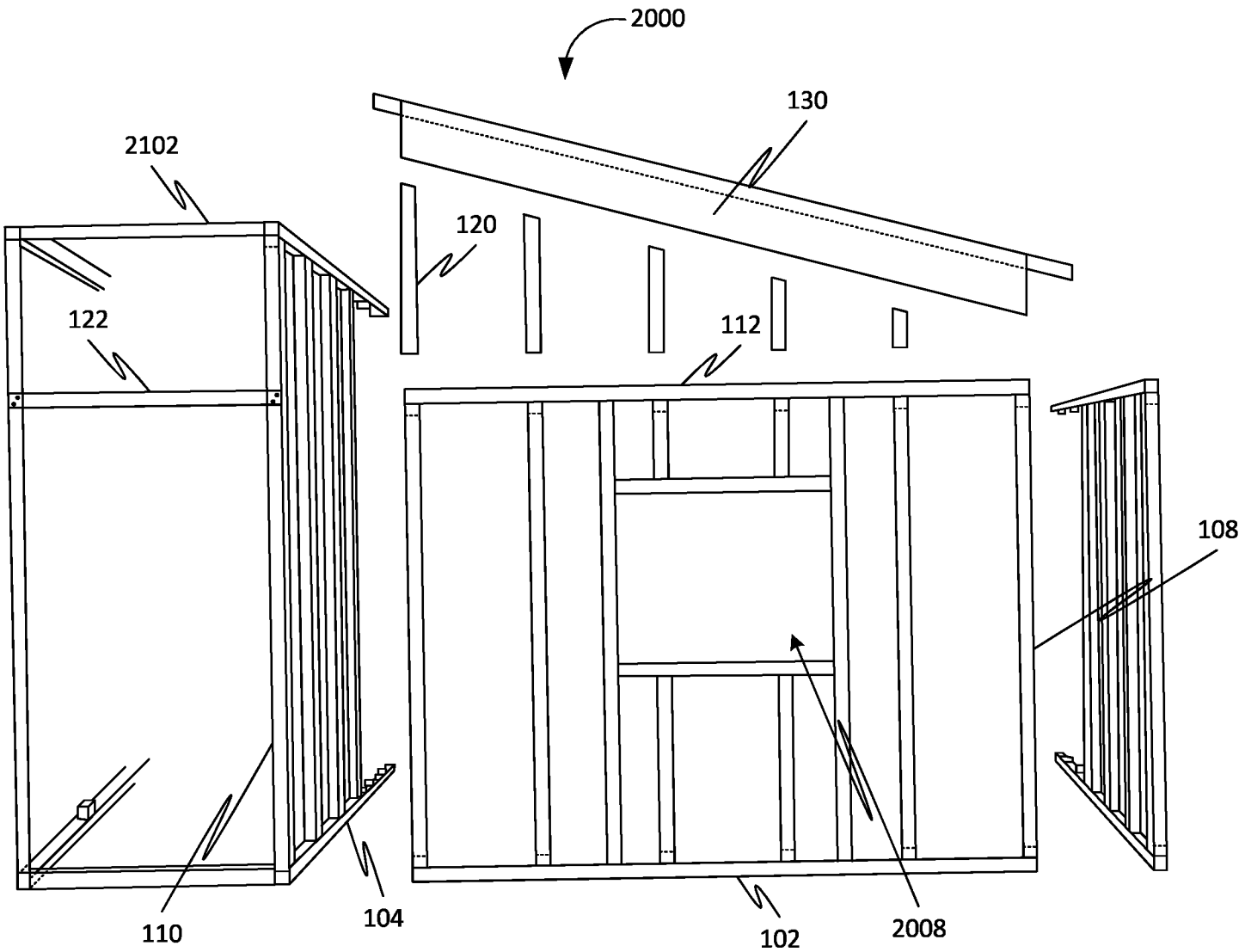
FIG. 26 is an exploded view of the right unit of the building frame with the center wall component, in accordance with some embodiments.

FIG. 25 is an exploded view of the interior right unit 2206 of the at least one internal blank wall 2202 of the building frame 2000, in accordance with some embodiments. Accordingly, the FIG. 26 is an exploded view of the right unit 2004 of the building frame 2000 with the center wall component 2102, in accordance with some embodiments.

Figure 27:
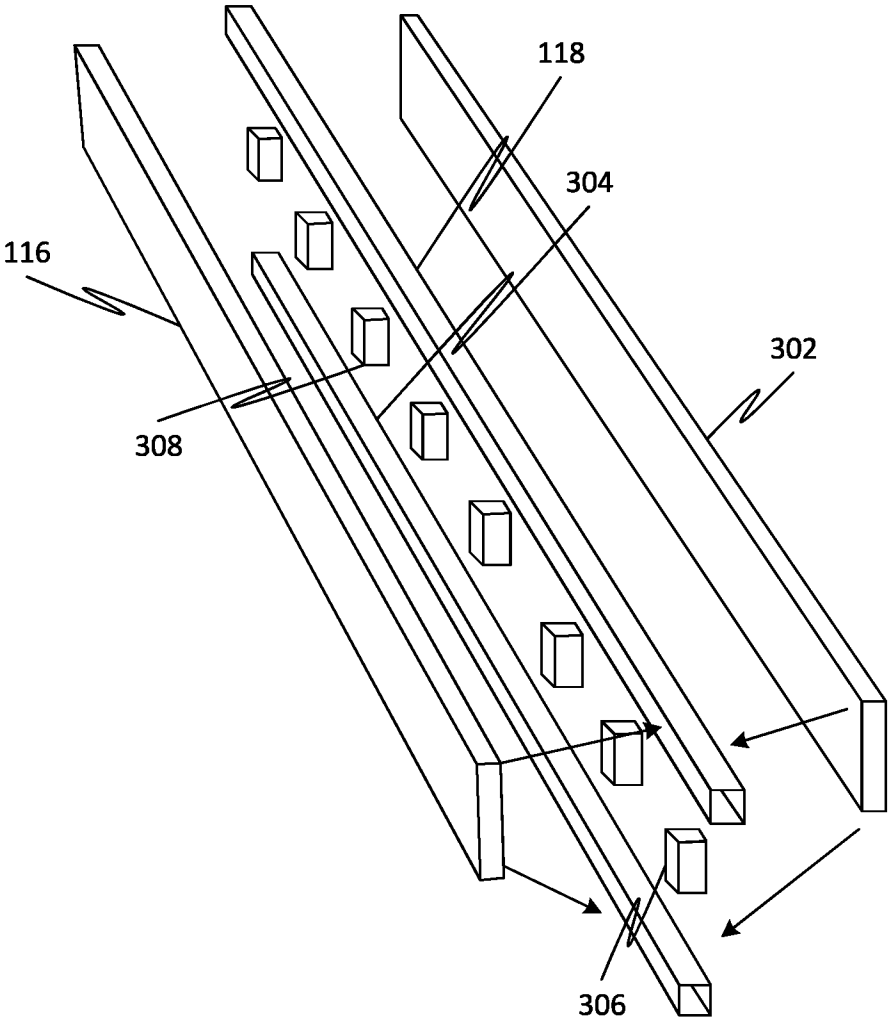
FIG. 27 is a top right perspective view of the rafter of the plurality of rafters, in accordance with some embodiments.

FIG. 27 is a top right perspective view of the rafter 130 of the plurality of rafters 130, in accordance with some embodiments.

Figure 28:
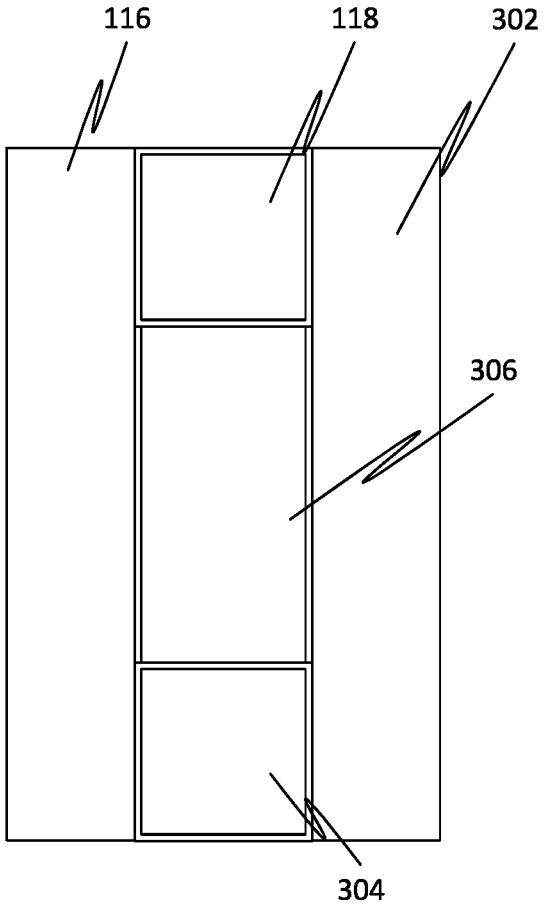
FIG. 28 is a right side view of the rafter of the plurality of rafters, in accordance with some embodiments.

FIG. 28 is a right side view of the rafter 130 of the plurality of rafters 130, in accordance with some embodiments.

Figure 29:
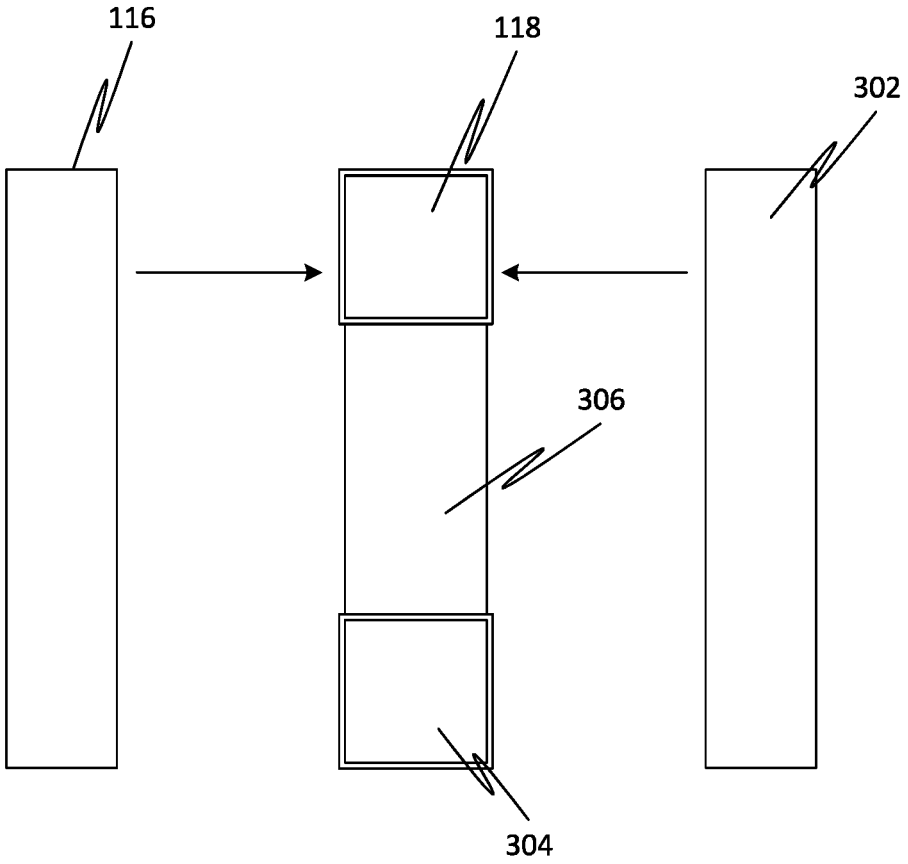
FIG. 29 is a right side view of the rafter of the plurality of rafters, in accordance with some embodiments.

FIG. 29 is a right side view of the rafter 130 of the plurality of rafters 130, in accordance with some embodiments.

Figure 30:
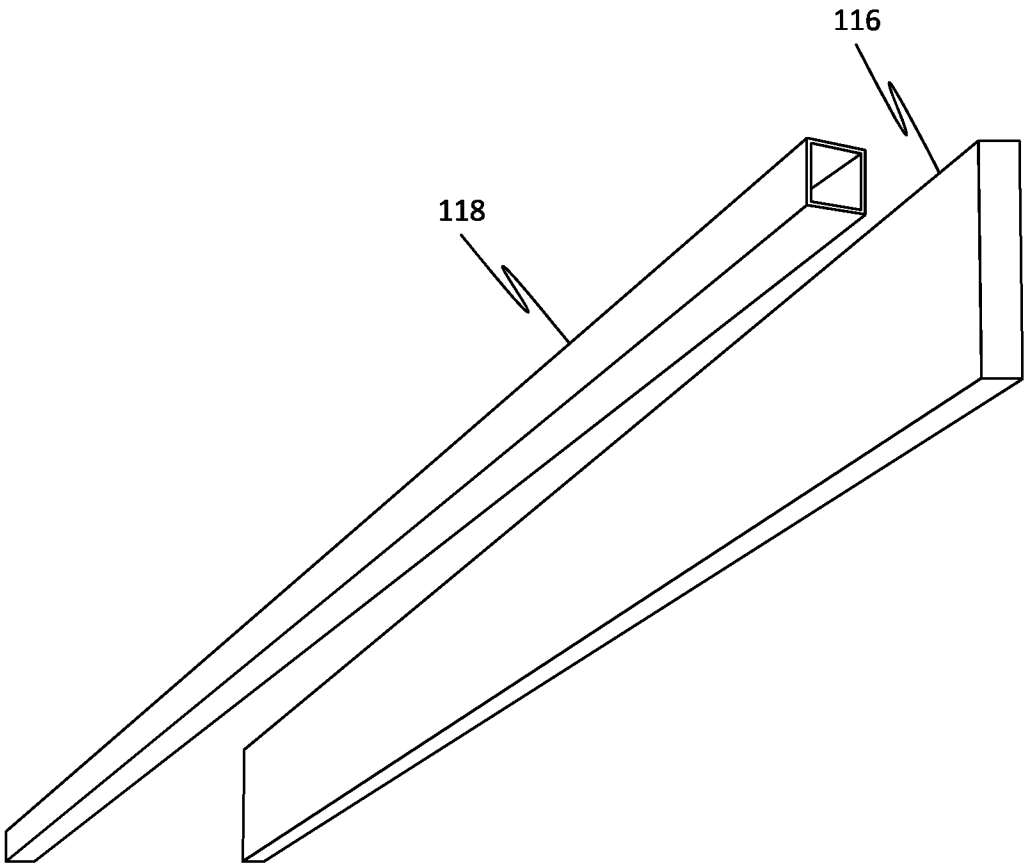
FIG. 30 is a bottom right side perspective view of the rafter of the plurality of rafters, in accordance with some embodiments.

FIG. 30 is a bottom right side perspective view of the rafter 130 of the plurality of rafters 130, in accordance with some embodiments.

Figure 31:
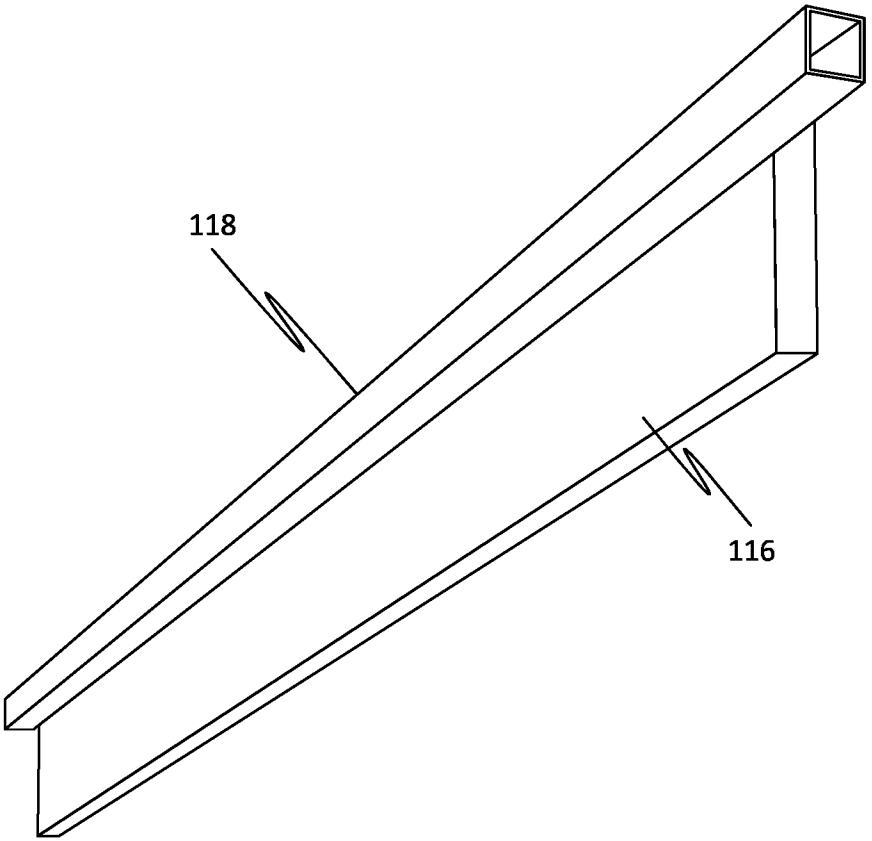
FIG. 31 is a bottom right side perspective view of the rafter of the plurality of rafters, in accordance with some embodiments.

FIG. 31 is a bottom right side perspective view of the rafter 130 of the plurality of rafters 130, in accordance with some embodiments.

Figure 32:
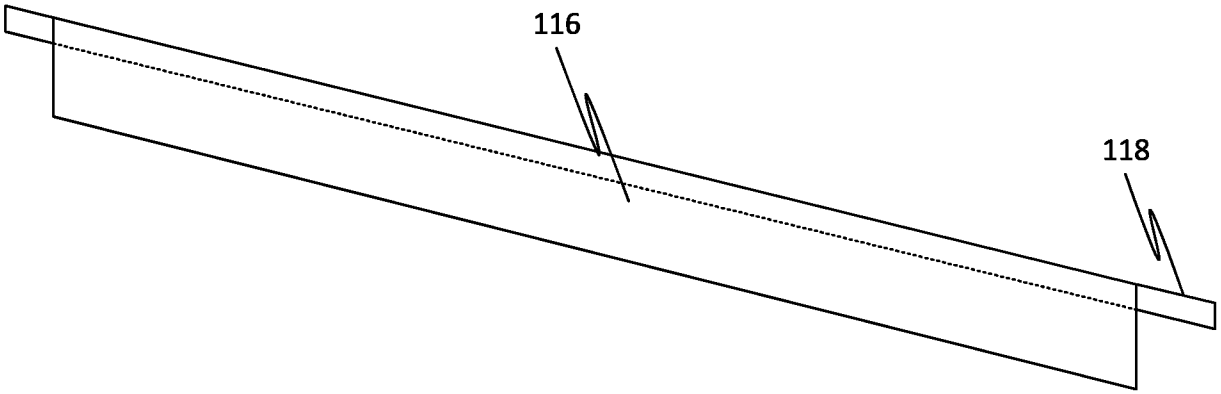
FIG. 32 is a rear bottom right perspective view of the rafter of the plurality of rafters, in accordance with some embodiments.

FIG. 32 is a rear bottom right perspective view of the rafter 130 of the plurality of rafters 130, in accordance with some embodiments.

Figure 33:
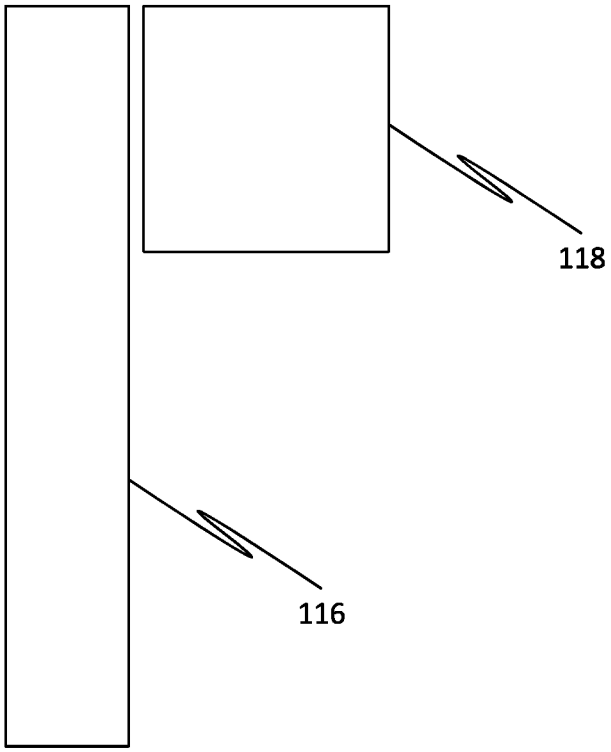
FIG. 33 is a left side view of the rafter of the plurality of rafters, in accordance with some embodiments.

FIG. 33 is a left side view of the rafter 130 of the plurality of rafters 130, in accordance with some embodiments.

Figure 34:
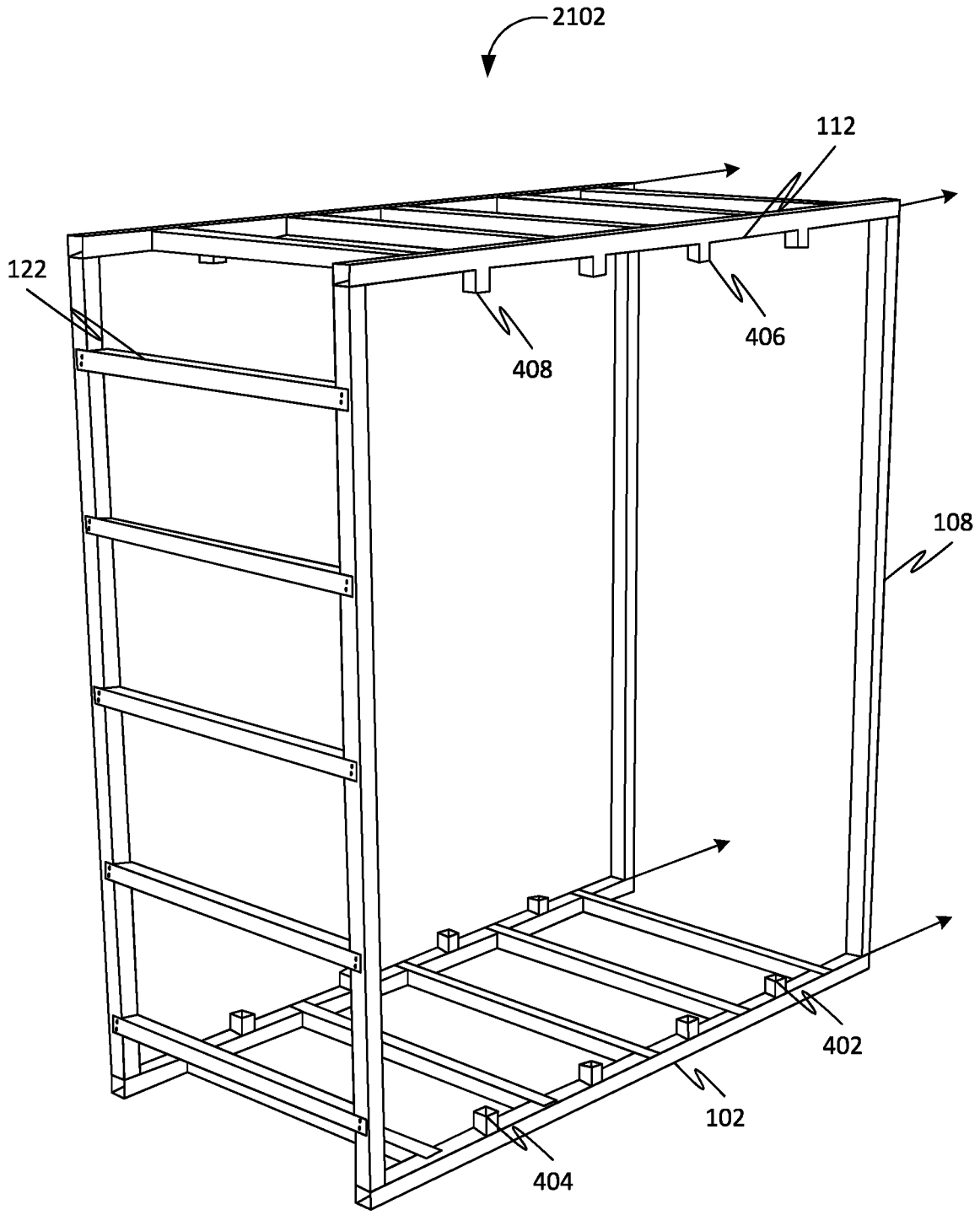
FIG. 34 is a front left side perspective view of the center wall component associated with the building frame, in accordance with some embodiments.

FIG. 34 is a front right side perspective view of the center wall component 2102 associated with the building frame 2000, in accordance with some embodiments.

Figure 35:
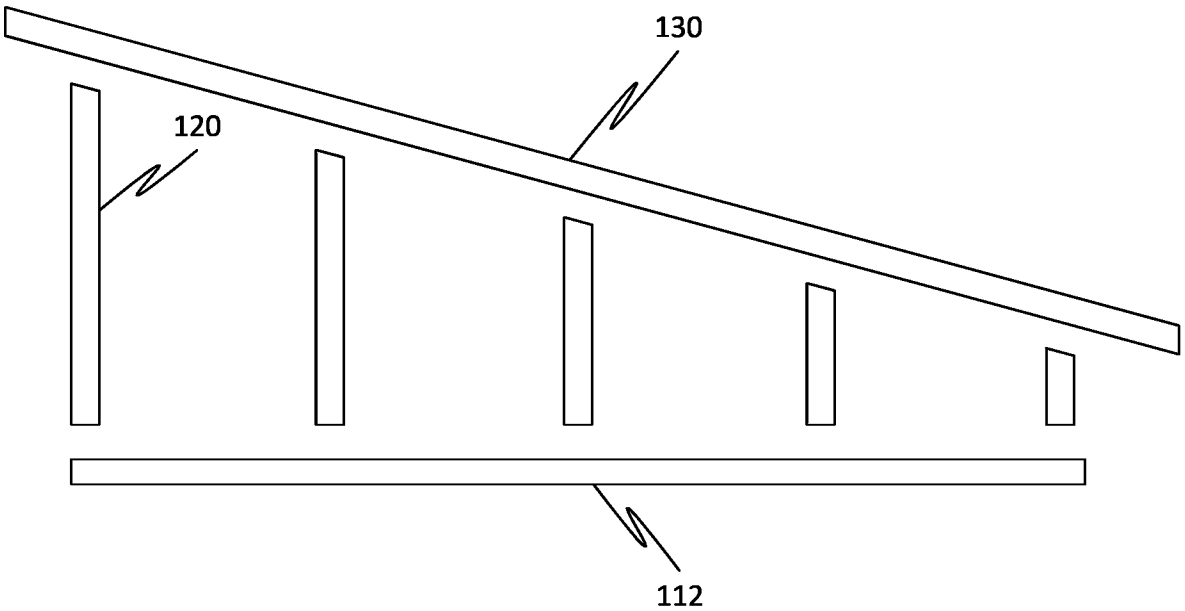
FIG. 35 is a side view of the rafter and the top plate with the plurality of braces, in accordance with some embodiments.

FIG. 35 is a side view of the rafter 130 and the top plate 112 with the plurality of braces 120-122, in accordance with some embodiments.

Figure 36:
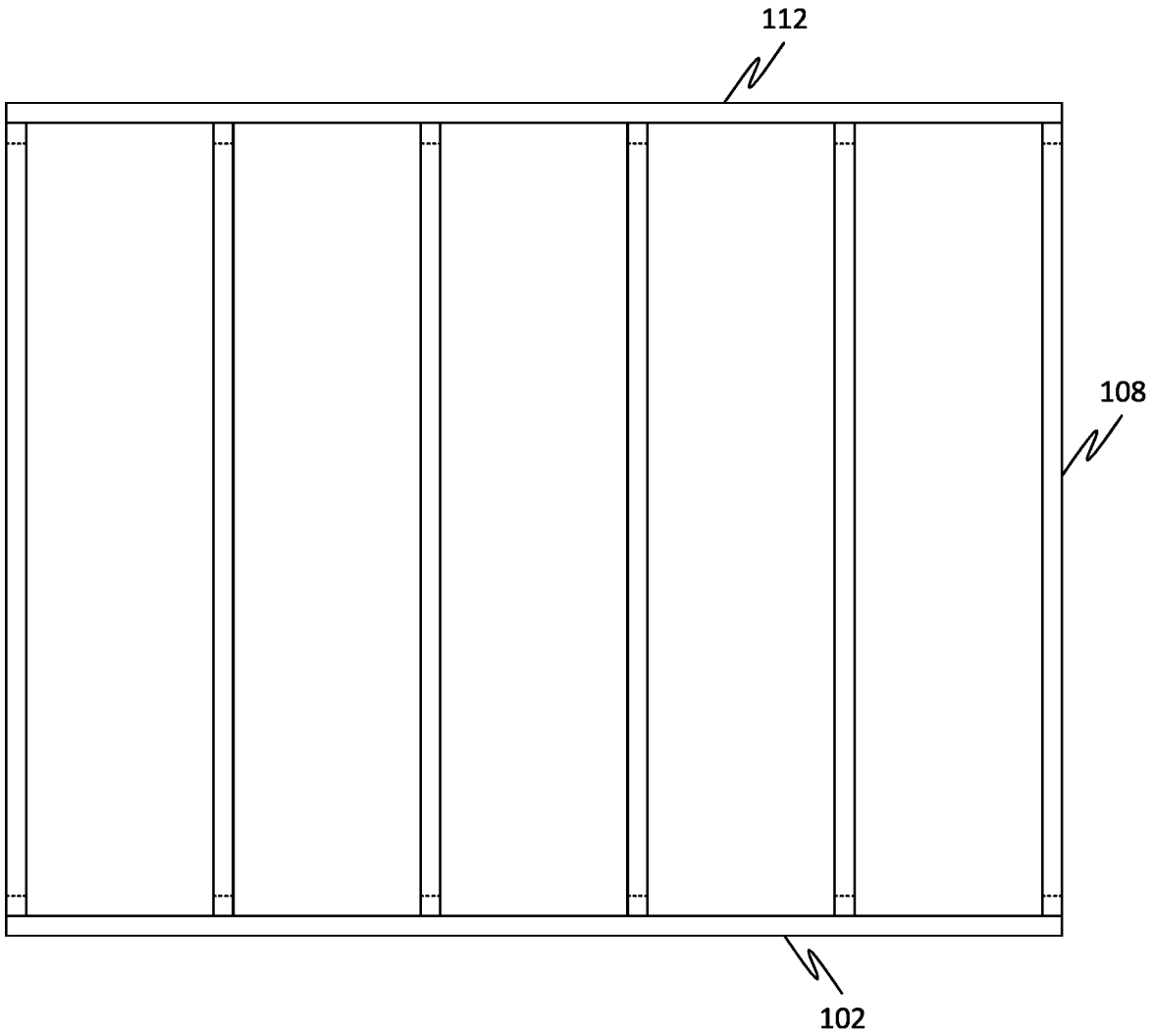
FIG. 36 is a front view of the base plate, the top plate, and the plurality of studs, in accordance with some embodiments.

FIG. 36 is a front view of the base plate 102, the top plate 112, and the plurality of studs 108-110, in accordance with some embodiments.

Figure 37:
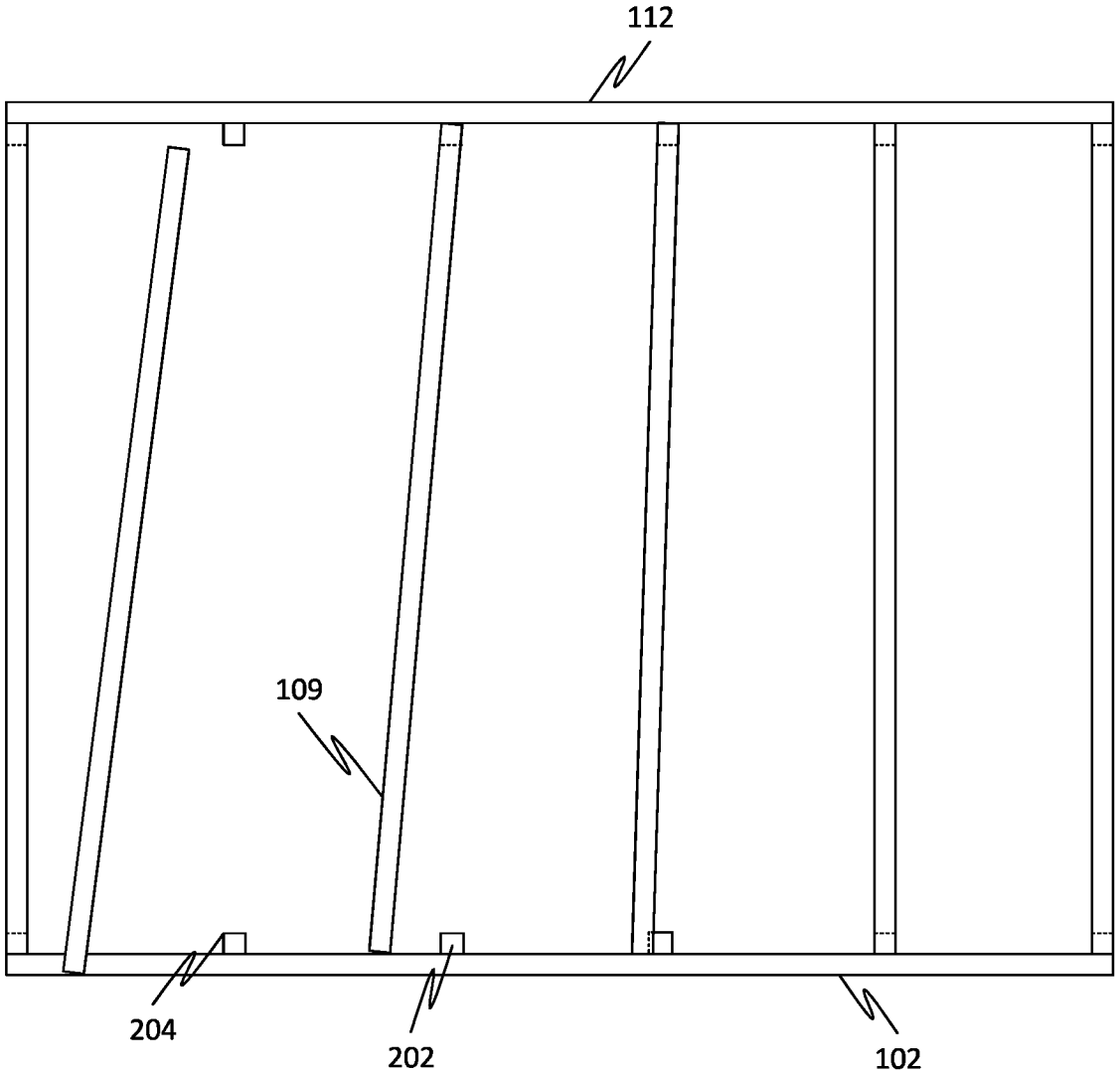
FIG. 37 is a front view of a stud of the plurality of studs being coupled with the base coupler of the plurality of base couplers, in accordance with some embodiments.

FIG. 37 is a front view of a stud 109 of the plurality of studs 108-110 being coupled with the base coupler 202 of the plurality of base couplers 202-204, in accordance with some embodiments.

Figure 38:
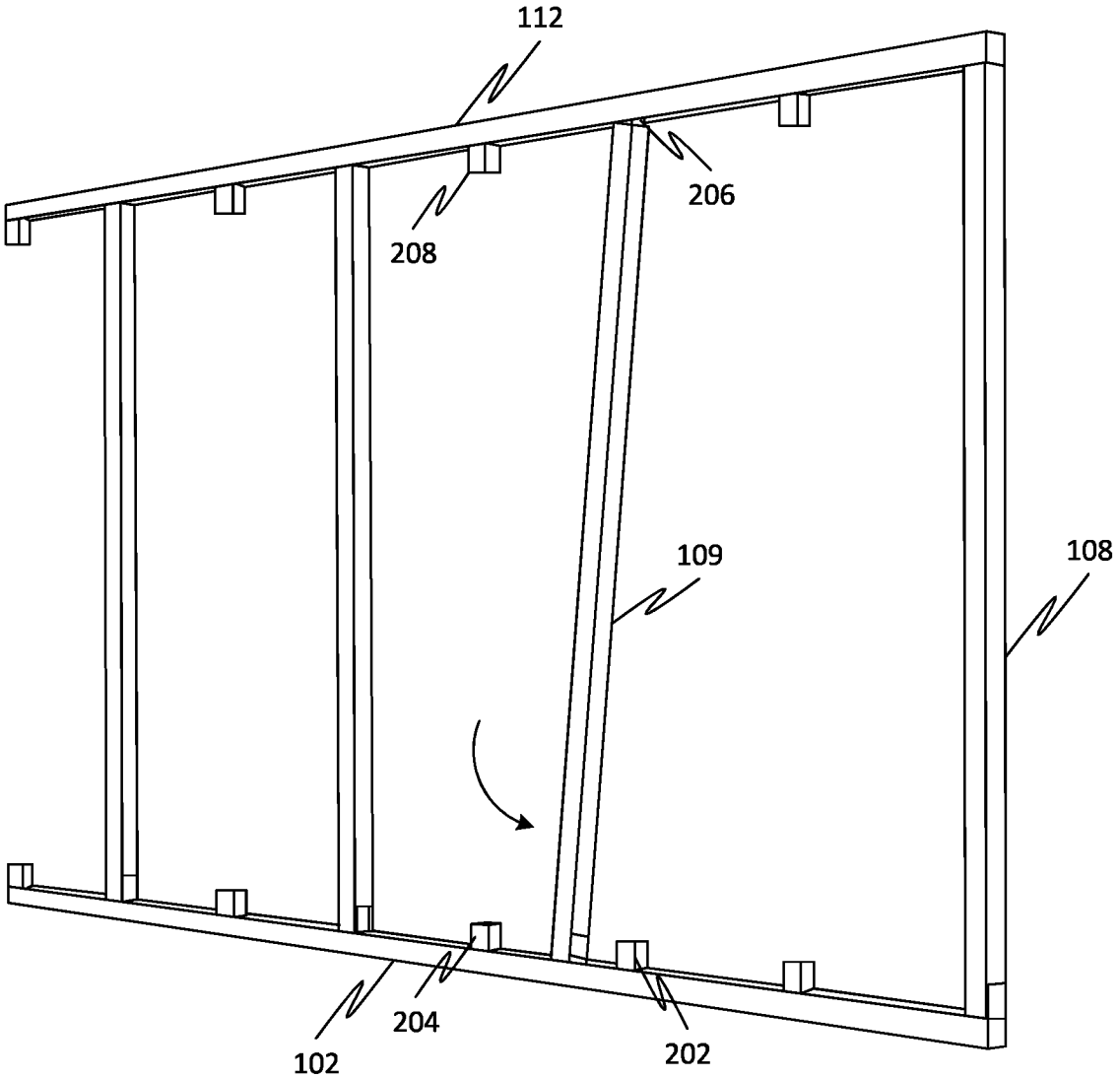
FIG. 38 is a front right side perspective view of the stud of the plurality of studs being coupled with the base coupler of the plurality of base couplers, in accordance with some embodiments.

FIG. 38 is a front right side perspective view of the stud 109 of the plurality of studs 108-110 being coupled with the base coupler 202 of the plurality of base couplers 202-204, in accordance with some embodiments.

Figure 39:
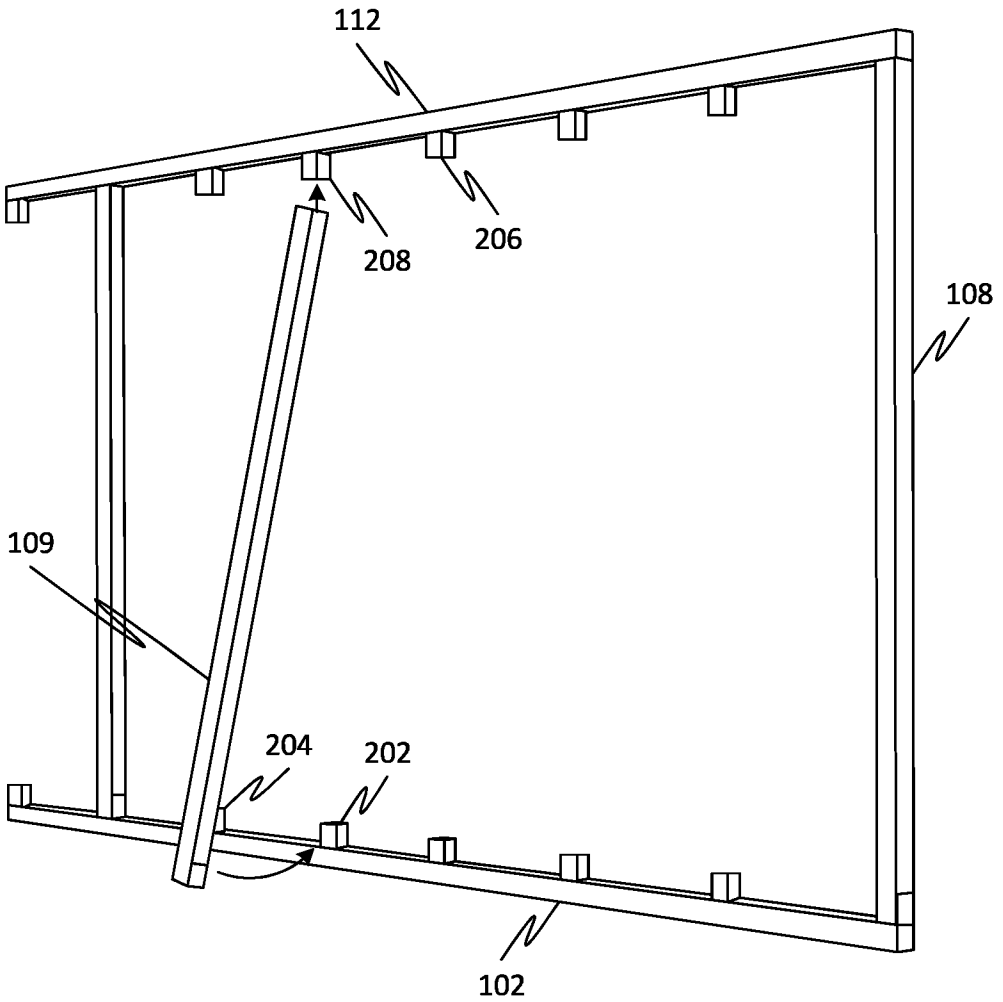
FIG. 39 is a front right side perspective view of the stud of the plurality of studs being coupled with the base coupler and the top coupler, in accordance with some embodiments.

FIG. 39 is a front right side perspective view of the stud 109 of the plurality of studs 108-110 being coupled with the base coupler 202 and the top coupler 206, in accordance with some embodiments.

Figure 40:
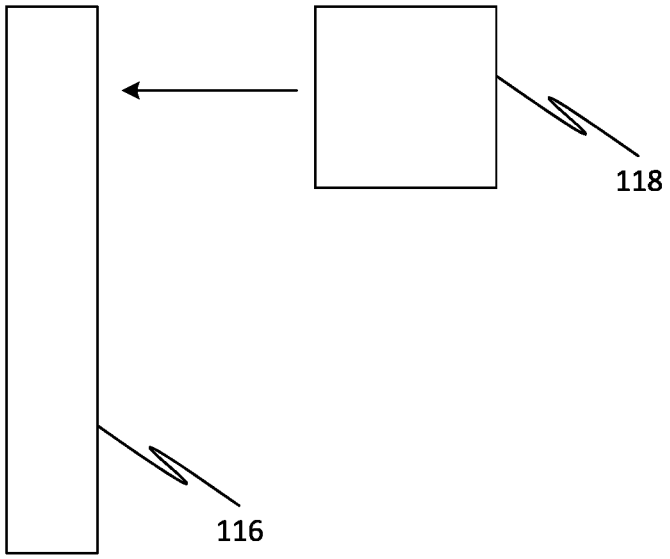
FIG. 40 is a left side view of the first cuboidal body and the first slab body, in accordance with some embodiments.

FIG. 40 is a left side view of the first cuboidal body 118 and the first slab body 116, in accordance with some embodiments.

Figure 41:
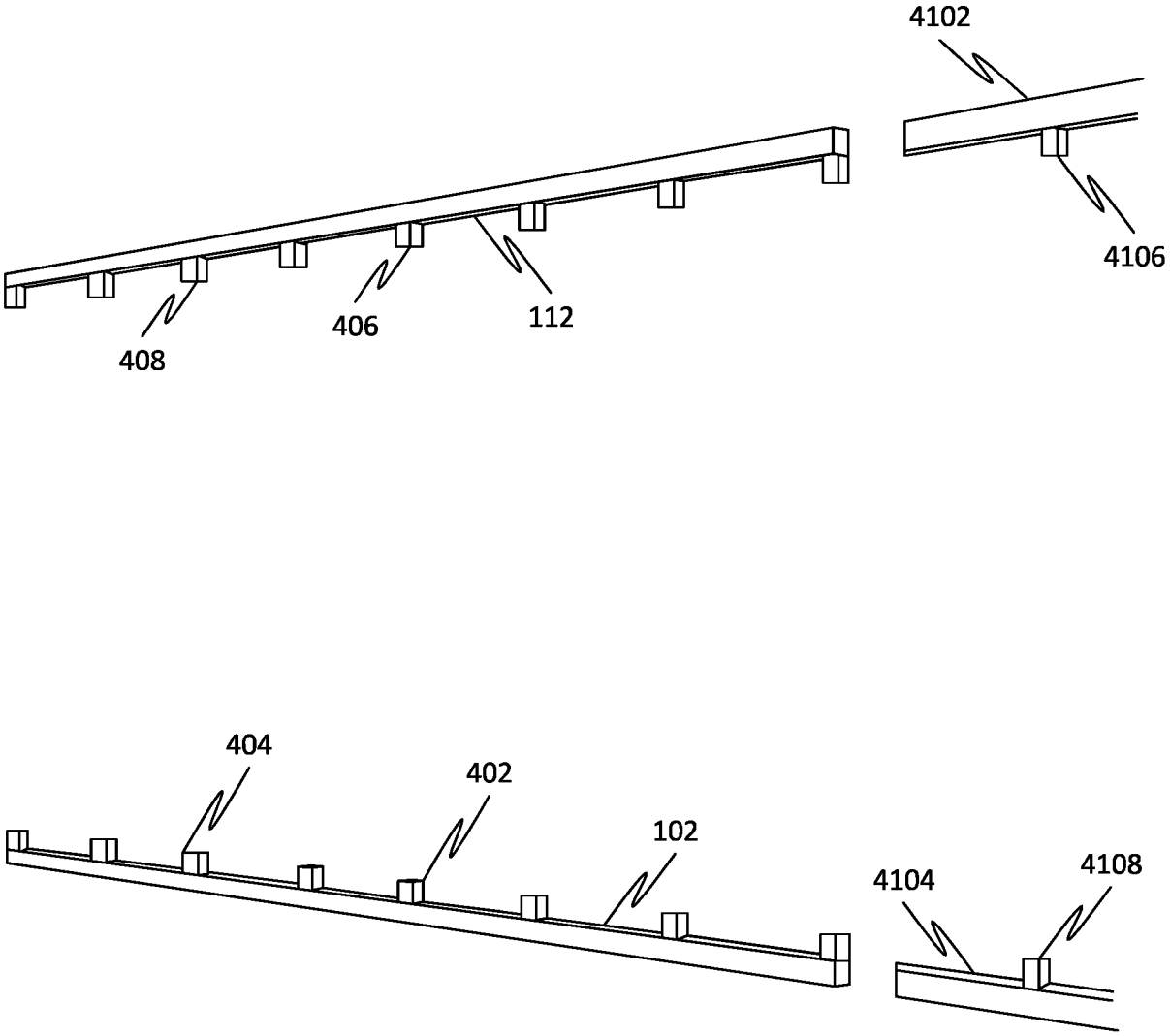
FIG. 41 is a front right side perspective view of the top plate and the base plate, in accordance with some embodiments.

FIG. 41 is a front right side perspective view of the top plate 112 and the base plate 102, in accordance with some embodiments. Accordingly, the top plate 112 may include a top extension 4102. Further, the base plate 102 may include a base extension 4104. Further, the top extension 4102 may include at least one top protrusion 4106. Further, the base extension 4104 may include at least one base protrusion 4108.

Figure 42:
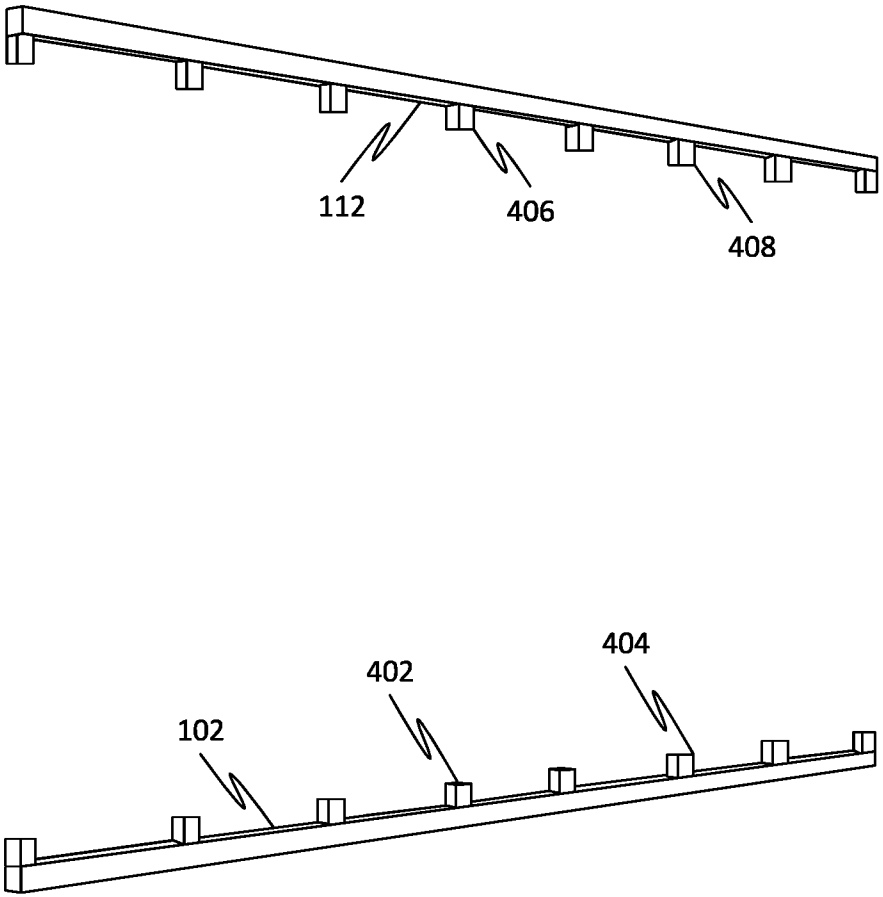
FIG. 42 is a front left side perspective view of the top plate and the base plate, in accordance with some embodiments.

FIG. 42 is a front left side perspective view of the top plate 112 and the base plate 102, in accordance with some embodiments.

Figure 43:
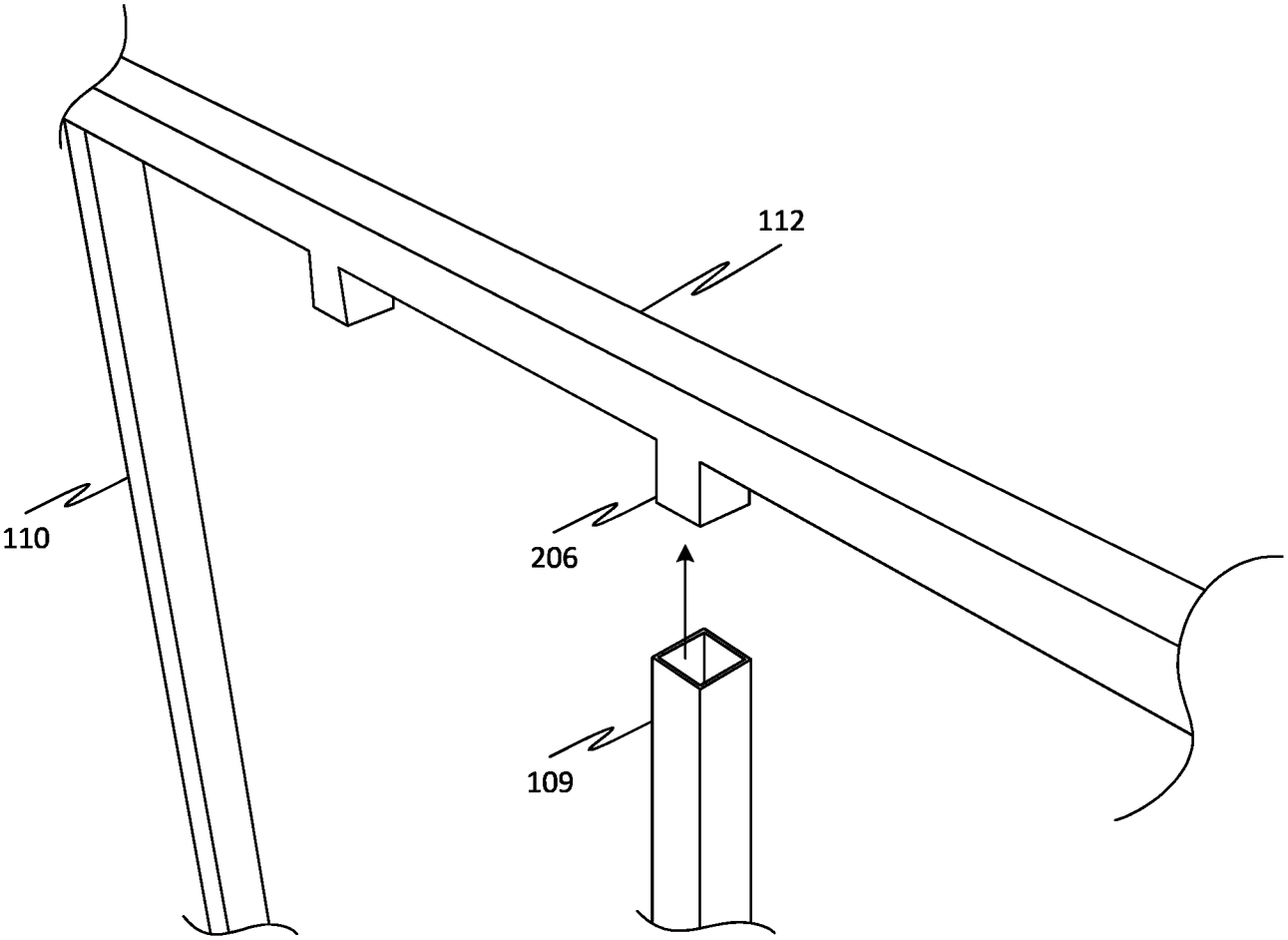
FIG. 43 is a partial top right side perspective view of the top plate with the stud of the plurality of studs being coupled with the top coupler of the plurality of top couplers, in accordance with some embodiments.

FIG. 43 is a partial top right side perspective view of the top plate 112 with the stud 109 of the plurality of studs 108-110 being coupled with the top coupler 206 of the plurality of top couplers 206-208, in accordance with some embodiments.

Figure 44:
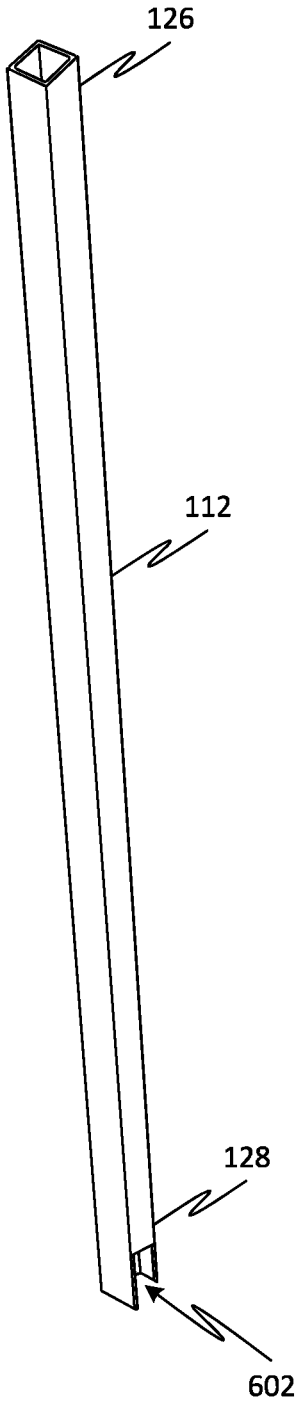
FIG. 44 is a right perspective side view of the stud, in accordance with some embodiments.

FIG. 44 is a right perspective side view of the stud 108, in accordance with some embodiments.

Figure 45:
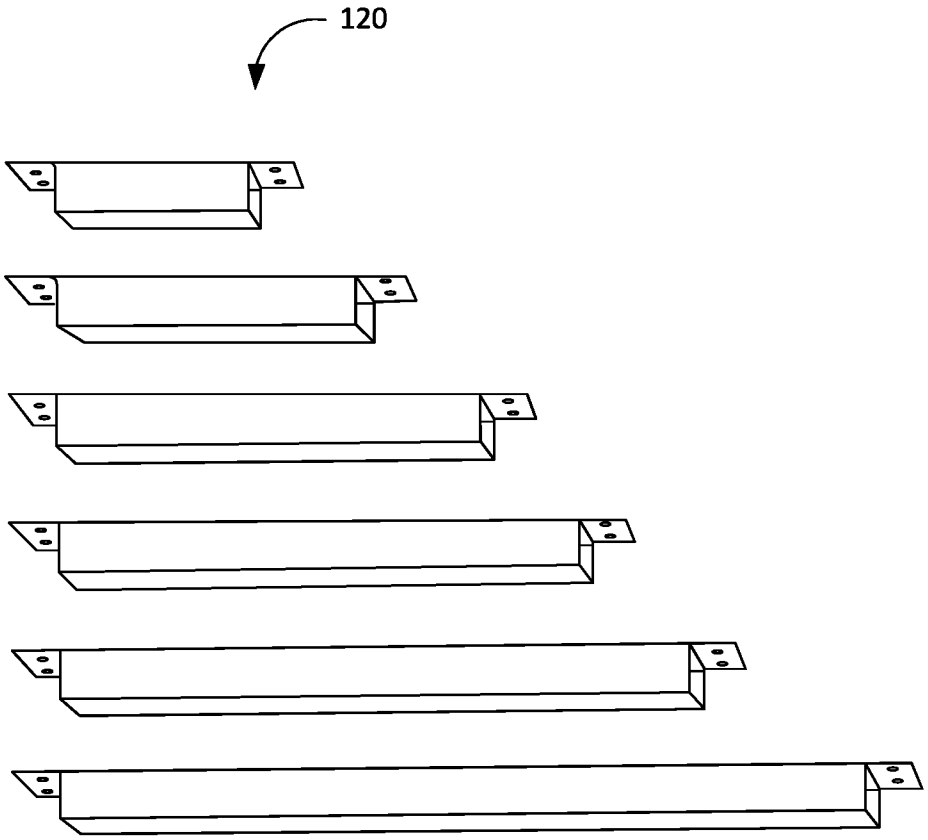
FIG. 45 is a side view of the brace of the plurality of braces, in accordance with some embodiments.

FIG. 45 is a side view of the brace 120 of the plurality of braces 120-122 associated with one or more sizes, in accordance with some embodiments. Accordingly, the brace 120 may be associated with one or more sizes. Further, the one or more sizes may include an extra small size, a small size, a medium-size, a large size, and so on.

Figure 46:
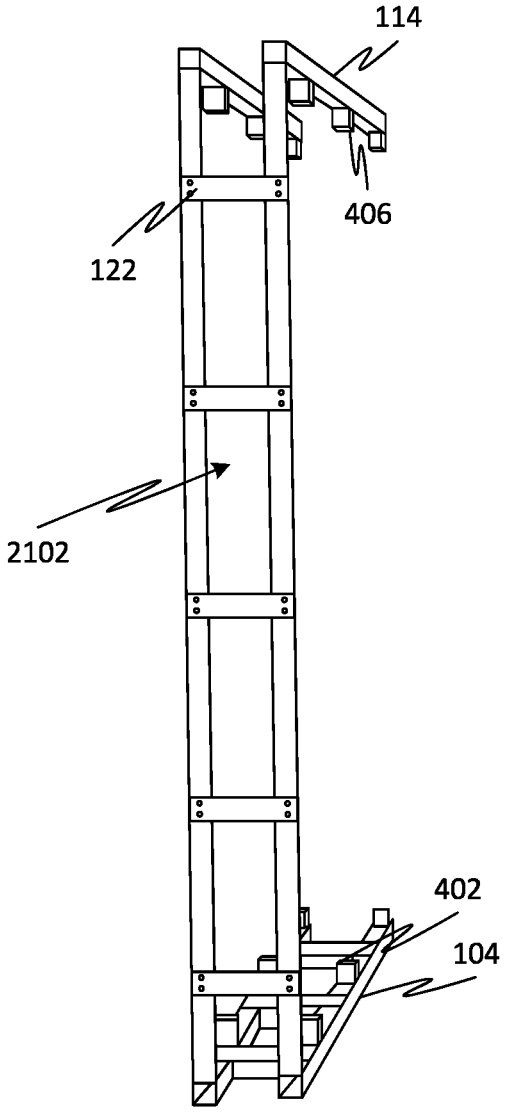
FIG. 46 is a front right side perspective view of the center component, in accordance with some embodiments.

FIG. 46 is a front right side perspective view of the center wall component 2102, in accordance with some embodiments.

Although the present disclosure has been explained in relation to its preferred embodiment, it is to be understood that many other possible modifications and variations can be made without departing from the spirit and scope of the disclosure.

What is claimed is:

1. An apparatus for a building frame designed to create a building, the apparatus comprising:

a plurality of base plates, wherein each of the plurality of base plates comprises:

an elongated base plate body comprising at least one external lower base plate surface configured to be placed in contact with a ground surface and at least one external upper base plate surface opposed to the at least one external lower base plate surface; and a plurality of base couplers disposed along a length of the elongated base plate body and on the at least one external upper base plate surface, wherein each of the plurality of base couplers is configured to be detachably attached with a lower stud end of each of a plurality of studs;

a plurality of top plates, wherein each of the plurality of top plates comprises:

an elongated top plate body comprising at least one external lower top plate surface and at least one external upper top plate surface opposed to the at least one external lower top plate surface; and a plurality of top couplers disposed along a length of the elongated top plate body and on the at least one external lower top plate surface, wherein each of the plurality of top couplers is configured to be detachably attached with an upper stud end of each of the plurality of studs;

the plurality of studs, wherein each of the plurality of studs comprises an elongated stud body having the upper stud end and the lower stud end, wherein the upper stud end is configured to be detachably attached with each of the plurality of top couplers, wherein the lower stud end is configured to be detachably attached with each of the plurality of base couplers;

a plurality of rafters, wherein each of the plurality of rafters comprises:

a first slab body comprising a first slab surface and a second slab surface opposing the first slab surface, wherein the first slab body is characterized by a first slab length, a first slab height, and a first slab width; and a first cuboidal body comprising a first cuboidal surface and a second cuboidal surface opposing the first cuboidal surface, wherein the second cuboidal surface is attached to the first slab surface along an upper boundary of the first slab surface, wherein the first cuboidal body is characterized by a first cuboidal width, a first cuboidal height and a first cuboidal length, wherein the first slab height is greater than the first cuboidal height by a predetermined ratio, wherein the first cuboidal length is greater than the first slab length by a predetermined extent, wherein an extended portion of the first cuboidal body equally extends out on at least two sides of the first slab body according to the predetermined extent; and a plurality of braces comprising a plurality of elongated brace bodies corresponding to a plurality of brace lengths, a first bracket attached to and extending from a first end of each of the plurality of elongated brace bodies and a second bracket attached to and extending from a second end of each of the plurality of elongated brace bodies, wherein each of the plurality of braces is configured to fasten any two of one of the plurality of base plates, one of the plurality of top plates, one of the plurality of studs, and one of the plurality of rafters together using a brace fastener.

2. The apparatus of claim 1, wherein each of the plurality of rafters further comprises:

a second slab body comprising a first slab surface and a second slab surface opposing the first slab of the second slab body, wherein the second slab body is characterized by a second slab length, a second slab height, and a second slab width;

a second cuboidal body comprising a first cuboidal surface and a second cuboidal surface opposing the first cuboidal surface of the second cuboidal body, wherein the second cuboidal surface of the second cuboidal body is attached to the first slab surface of the first slab body along a lower boundary of the first slab surface of the first slab body, wherein the first cuboidal surface of the second cuboidal body is attached to the second slab surface of the second slab body along a lower boundary of the second slab surface of the second slab body, wherein the second cuboidal body is characterized by a second cuboidal width, a second cuboidal height, and a second cuboidal length, wherein the first slab height is greater than the second cuboidal height by the predetermined ratio, wherein the second cuboidal length is identical to the first slab length, wherein the second cuboidal body is further attached the first cuboidal body through a plurality of blocks; and the plurality of blocks, wherein each of the plurality of blocks comprises a first block surface, a second block surface, a bottom block surface, and a top block surface, wherein the second block surface is attached to the first slab surface of the first slab body, wherein the first block surface is attached to the second slab surface of the second slab body, wherein the top block surface is attached to a first lower cuboidal surface, wherein the lower block surface is attached to a second upper cuboidal surface.

3. The apparatus of claim 1, wherein each of the plurality of base couplers and the at least one external upper base plate surface is configured to be attached together using at least one of a base fastener and welding, wherein each of the plurality of top couplers and the at least one external lower top plate surface is configured to be attached together using at least one of a top fastener and welding.

4. The apparatus of claim 1, wherein the elongated base plate body comprises a hollow cuboidal body characterized by a width, a height, a length, and a thickness, wherein the at least one external lower base plate surface comprises a lower side surface of the hollow cuboidal body, wherein the at least one external upper base plate surface comprises an upper side surface of the hollow cuboidal body.

5. The apparatus of claim 1, wherein the elongated top plate body comprises a hollow cuboidal body characterized by a width, a height, a length, and a thickness, wherein the at least one external lower top plate surface comprises a lower side surface of the hollow cuboidal body, wherein the at least one external upper top plate surface comprises an upper side surface of the hollow cuboidal body.

6. The apparatus of claim 1, wherein each of the upper stud end of one of the plurality of studs and one of the plurality of top couplers is configured to be detachably attached together without any fastener, wherein each of the lower stud end of one of the plurality of studs and one of the plurality of base couplers is configured to be detachably attached together without any fastener.

7. The apparatus of claim 1, wherein attaching of the upper stud end of one of the plurality of studs and one of the plurality of to couplers prevents any linear movement of one of the plurality of studs in relation to one of the plurality of top plates comprising one of the plurality of top couplers, wherein attaching of the lower stud end of one of the plurality of studs and one of the plurality of base couplers prevents any linear movement of one of the plurality of studs in relation to one of the plurality of base plates comprising one of the plurality of base couplers.

8. The apparatus of claim 1, wherein the plurality of base couplers is disposed equidistantly on one of the plurality of base plates, wherein the plurality of top couplers is disposed equidistantly on one of the plurality of top plates, wherein a base plate length of one of the plurality of base plates is identical to a top plate length of one of the plurality of top plates, wherein aligning a first base plate end of one of the plurality of base plates with a first top plate end of one of the plurality of top plates and aligning a second base plate end of one of the base plurality of top plates with a second top plate end of one of the plurality of top plates results in an alignment of the plurality of top couplers with the plurality of base couplers.

9. The apparatus of claim 1, wherein the plurality of base plates is identical to the plurality of top plates.

10. The apparatus of claim 1, wherein the plurality of base couplers comprises a plurality of base protrusions, wherein each of the plurality of base protrusions is characterized by a protrusion width and a protrusion height, wherein the protrusion width is a measure of spatial extension of one of the plurality of base protrusions along a plane parallel to the at least one external upper base plate surface, wherein the protrusion height is a measure of spatial extension of one of the plurality of base protrusions along a plane perpendicular to the at least one external upper base plate surface, wherein the lower stud end comprises a lower stud receptacle configured to receive one of the plurality of base protrusions, wherein the lower stud receptacle is characterized by a receptacle depth and a receptacle width, wherein receptacle depth is greater than the protrusion height, wherein the receptacle width is greater than the protrusion width by a predetermined clearance, wherein the plurality of top couplers comprises a plurality of top protrusions, wherein the upper stud end comprises an upper stud receptacle configured to receive one of the plurality of top protrusions.

11. The apparatus of claim 10, wherein the elongated stud body comprises a hollow cuboidal body characterized by a stud width, a stud height, a stud length, and a stud thickness, wherein the lower stud end comprises a cut-away opening on a first side of the hollow cuboidal body, wherein the cut-away opening is characterized by a cut-away width and a cut-away height, wherein the cut-away width is greater than the protrusion width by the predetermined clearance, wherein the cut-away height is greater than the protrusion height by the predetermined clearance.

12. The apparatus of claim 1, wherein the plurality of base plates comprises a first base plate and a second base plate, wherein the first base plate comprises a first base plate end and a second base plate end, wherein the second base plate comprises a third base plate end and a fourth base plate end, wherein the first base plate end is configured to be detachably attached to the third base plate end.

13. The apparatus of claim 1, wherein each of the plurality of base plates, the plurality of top plates, the plurality of studs, the plurality of rafters, and the plurality of braces comprise a plurality of apertures configured to receive at least a portion of the brace fastener in order to fasten any two of one of the plurality of base plates, one of the plurality of top plates, one of the plurality of studs, on of the plurality of rafters together.

14. The apparatus of claim 1, wherein the elongated brace body comprises a cuboidal body characterized by a width, a height, a length, and a thickness, wherein the first bracket comprises a rectangular plate characterized by a bracket width and a bracket length, wherein the first bracket is perpendicular to the first end of the elongated brace body, wherein each of the height of the cuboidal body and the bracket length is configured to snugly fit against a portion of at least one of one of the plurality of base plates, one of the plurality of top plates, on of the plurality of studs, and one of the plurality of rafters.

15. An apparatus for a building frame designed to create a building, the apparatus comprising:

a plurality of base plates, wherein each of the plurality of base plates comprises an elongated base plate body comprising at least one external lower base plate surface configured to be placed in contact with a ground surface and at least one external upper base plate surface opposed to the at least one external lower base plate surface;

a plurality of base couplers configured to be detachably attached along a length of the elongated base plate body and on the at least one external upper base plate surface using a base coupler fastener, wherein each of a plurality of base couplers is configured to be detachably attached with a lower stud end of each of a plurality of studs, wherein each of the plurality of base couplers comprises a base coupler aperture configured to receive the base coupler fastener, wherein the at least one external upper base plate surface comprises a base plate aperture configured to receive the base coupler fastener;

a plurality of top plates, wherein each of the plurality of top plates comprises an elongated top plate body comprising at least one external lower top plate surface and at least one external upper top plate surface opposed to the at least one external lower top plate surface;

a plurality of top couplers configured to be detachably attached along a length of the elongated top plate body and on the at least one external lower top plate surface using a top coupler fastener, wherein each of the plurality of top couplers is configured to be detachably attached with an upper stud end of each of the plurality of studs, wherein each of the plurality of top couplers comprises a top coupler aperture configured to receive the top coupler fastener, wherein the at least one external lower top plate surface comprises a top plate aperture configured to receive the top coupler fastener;

the plurality of studs, wherein each of the plurality of studs comprises an elongated stud body having the upper stud end and the lower stud end, wherein the upper stud end is configured to be detachably attached with each of the plurality of top couplers, wherein the lower stud end is configured to be detachably attached with each of the plurality of base couplers;

a plurality of rafters, wherein each of the plurality of rafters comprises:

a first slab body comprising a first slab surface and a second slab surface opposing the first slab surface, wherein the first slab body is characterized by a first slab length, a first slab height, and a first slab width; and a first cuboidal body comprising a first cuboidal surface and a first second cuboidal surface opposing the first cuboidal surface, wherein the second cuboidal surface is attached to the first slab surface along an upper boundary of the first slab surface, wherein the first cuboidal body is characterized by a first cuboidal width, a first cuboidal height and a first cuboidal length, wherein the first slab height is greater than the first cuboidal height by a predetermined ratio, wherein the first cuboidal length is greater than the first slab length by a predetermined extent, wherein an extended portion of the first cuboidal body equally extends out on at least two sides of the first slab body according to the predetermined extent; and a plurality of braces comprising a plurality of elongated brace bodies corresponding to a plurality of brace lengths, a first bracket attached to and extending from a first end of each of the plurality of elongated brace bodies, and a second bracket attached to and extending from a second end of each of the plurality of elongated brace bodies, wherein each of the plurality of braces is configured to fasten any two of one of the plurality of base plates, one of the plurality of top plates, one of the plurality of studs, and one of the plurality of rafters together using a brace fastener.

16. An apparatus for a building frame designed to create a building, the apparatus comprising:

a plurality of base plates, wherein each of the plurality of base plates comprises:

an elongated base plate body comprising at least one external lower base plate surface configured to be placed in contact with a ground surface and at least one external upper base plate surface opposed to the at least one external lower base plate surface; and a plurality of base couplers disposed along a length of the elongated base plate body and on the at least one external upper base plate surface, wherein each of the plurality of base couplers is configured to be detachably attached with a lower stud end of each of the plurality of studs, wherein the plurality of base couplers comprises a plurality of base protrusions, wherein each of the plurality of base protrusions is characterized by a protrusion width and a protrusion height, wherein the lower stud end comprises a lower stud receptacle configured to receive one of the plurality of base protrusions, wherein the lower stud receptacle is characterized by a receptacle depth and a receptacle width, wherein receptacle depth is greater than the protrusion height, wherein the receptacle width is greater than the protrusion width by a predetermined clearance, wherein the plurality of top couplers comprises a plurality of top protrusions, wherein the upper stud end comprises an upper stud receptacle configured to receive one of the plurality of top protrusions, wherein the elongated stud body comprises a hollow cuboidal body characterized by a stud width, a stud height, a stud length and a stud thickness, wherein the lower stud end comprises a cut-away opening on a first side of the hollow cuboidal body, wherein the cut-away opening is characterized by a cut-away width and a cut-away height, wherein the cut-away width is greater than the protrusion width by the predetermined clearance, wherein the cut-away height is greater than the protrusion height by the predetermined clearance;

a plurality of top plates, wherein each of the plurality of top plates comprises:

an elongated top plate body comprising at least one external lower top plate surface and at least one external upper top plate surface opposed to the at least one external lower top plate surface; and a plurality of top couplers disposed along a length of the elongated top plate body and on the at least one external lower top plate surface, wherein each top coupler is configured to be detachably attached with an upper stud end of each of the plurality of studs;

the plurality of studs, wherein each of the plurality of studs comprises an elongated stud body having the upper stud end and a lower stud end, wherein the upper stud end is configured to be detachably attached with each of the plurality of top couplers, wherein the lower stud end is configured to be detachably attached with each of the plurality of base couplers;

a plurality of rafters, wherein each of the plurality of rafters comprises:

a first slab body comprising a first slab surface and a second slab surface opposing the first slab surface, wherein the first slab body is characterized by a first slab length, a first slab height, and a first slab width; and a first cuboidal body comprising a first cuboidal surface and a second cuboidal surface opposing the first cuboidal surface, wherein the second cuboidal surface is attached to the first slab surface along an upper boundary of the first slab surface, wherein the first cuboidal body is characterized by a first cuboidal width, a first cuboidal height and a first cuboidal length, wherein the first slab height is greater than the first cuboidal height by a predetermined ratio, wherein the first cuboidal length is greater than the first slab length by a predetermined extent, wherein an extended portion of the first cuboidal body equally extends out on at least two sides of the first slab body according to the predetermined extent; and a plurality of braces comprising a plurality of elongated brace bodies corresponding to a plurality of brace lengths, a first bracket attached to and extending from a first end of each of the plurality of elongated brace bodies, and a second bracket attached to and extending from a second end of each of the plurality of elongated brace bodies, wherein each of the plurality of braces is configured to fasten any two of one of the plurality of base plates, one of the plurality of top plates, one of the plurality of studs, and one of the plurality of rafters together using a brace fastener.

17. The apparatus of claim 16, wherein the plurality of base couplers is disposed equidistantly on one of the plurality of base plates, wherein the plurality of top couplers is disposed equidistantly on one of the plurality of top plates, wherein a base plate length of one of the plurality of base plates is identical to a top plate length of one of the plurality of top plates, wherein aligning a first base plate end of one of the plurality of base plates with a first top plate end of one of the plurality of top plates and aligning a second base plate end of one of the plurality of base plates with a second top plate end of one of the plurality of top plates results in an alignment of the plurality of top couplers with the plurality of base couplers.

18. The apparatus of claim 16, wherein each of the plurality of rafters further comprises:

a second slab body comprising a first slab surface and a second slab surface opposing the first slab surface, wherein the second slab body is characterized by a second slab length, a second slab height, and a second slab width;

a second cuboidal body comprising a first cuboidal surface and a second cuboidal surface opposing the first cuboidal of the second cuboidal body, wherein the second cuboidal surface of the second cuboidal body is attached to the first slab surface of the first slab body along a lower boundary of the first slab surface of the first slab body, wherein the first cuboidal surface of the second cuboidal body is attached to the second slab surface of the second slab body along a lower boundary of the second slab surface of the second slab body, wherein the second cuboidal body is characterized by a second cuboidal width, a second cuboidal height, and a second cuboidal length, wherein the first slab height is greater than the second cuboidal height by the predetermined ratio, wherein the second cuboidal length is identical to the first slab length, wherein the second cuboidal body is further attached the first cuboidal body through a plurality of blocks; and the plurality of blocks, wherein each of the plurality of blocks comprises a first block surface, a second block surface, a bottom block surface, and a top block surface, wherein the second block surface is attached to the first slab surface of the first slab body, wherein the first block surface is attached to the second slab surface of the second slab body, wherein the top block surface is attached to a first lower cuboidal surface, wherein the lower block surface is attached to a second upper cuboidal surface.

19. The apparatus of claim 16, wherein the elongated brace body comprises a cuboidal body characterized by a width, a height, a length, and a thickness, wherein the first bracket comprises a rectangular plate characterized by a bracket width and a bracket length, wherein the first bracket is perpendicular to the first end of the elongated brace body, wherein each of the height of the cuboidal body and the bracket length is configured to snugly fit against a portion of at least one of one of the plurality of base plates, one of the plurality of top plates, one of the plurality of studs, and one of the plurality of rafters.

20. The apparatus of claim 16, wherein each of the upper stud end of one of the plurality of studs and one of the plurality of top couplers is configured to be detachably attached together without any fastener, wherein each of the lower stud end of one of the plurality of studs and one of the plurality of base couplers is configured to be detachably attached together without any fastener.

* * * * *